US011053939B2

(12) United States Patent
Iwatake et al.

(10) Patent No.: US 11,053,939 B2
(45) Date of Patent: Jul. 6, 2021

(54) SCROLL COMPRESSOR AND REFRIGERATION CYCLE APPARATUS INCLUDING FIXED SCROLL BASEPLATE INJECTION PORT

(71) Applicant: Mitsubishi Electric Corporation, Chiyoda-ku (JP)

(72) Inventors: Wataru Iwatake, Chiyoda-ku (JP); Shin Sekiya, Chiyoda-ku (JP); Raito Kawamura, Chiyoda-ku (JP); Kei Sasaki, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 321 days.

(21) Appl. No.: 15/781,561

(22) PCT Filed: Oct. 27, 2016

(86) PCT No.: PCT/JP2016/081849
§ 371 (c)(1),
(2) Date: Jun. 5, 2018

(87) PCT Pub. No.: WO2017/126181
PCT Pub. Date: Jul. 27, 2017

(65) Prior Publication Data

US 2020/0018311 A1 Jan. 16, 2020

(30) Foreign Application Priority Data

Jan. 19, 2016 (JP) ..... JP2016-007989

(51) Int. Cl.
*F04C 18/02* (2006.01)
*F04C 27/00* (2006.01)

(52) U.S. Cl.
CPC ..... *F04C 18/0261* (2013.01); *F04C 18/0207* (2013.01); *F04C 18/0215* (2013.01); *F04C 27/005* (2013.01)

(58) Field of Classification Search
CPC .. F04C 18/02; F04C 18/0207; F04C 18/0215; F04C 18/0261; F04C 23/008;
(Continued)

(56) References Cited

U.S. PATENT DOCUMENTS 5,722,257 A * 3/1998 Ishii ..... F04C 29/0035 418/55.5
10,890,184 B2 * 1/2021 Iwatake ..... F04C 29/12
(Continued)

FOREIGN PATENT DOCUMENTS

EP 0922860 A1 * 6/1999 ..... F04C 29/122
JP 10-37868 A 2/1998

OTHER PUBLICATIONS

International Search Report dated Jan. 24, 2017 in PCT/JP2016/081849, filed on Oct. 27, 2016.

*Primary Examiner* — Mary Davis
*Assistant Examiner* — Paul W Thiede
(74) *Attorney, Agent, or Firm* — Xsensus LLP

(57) ABSTRACT

A first injection port is open to a suction chamber of a plurality of chambers at some rotation phases, and is located within an angular range defined by a line connecting a winding-end contact point of an orbiting scroll at a compression start phase with a base circle center of a fixed scroll and one of two lines tangent to a winding-end point locus of a tip seal at a tooth tip of a spiral body of the orbiting scroll and passing through a base circle center of the orbiting scroll, the one line of the two tangent lines being closer to
(Continued)

the winding-end contact point. The first injection port does not interfere with the tip seal at the tooth tip of the spiral body of the orbiting scroll.

9 Claims, 36 Drawing Sheets

(58) Field of Classification Search
CPC ..... F04C 27/005; F04C 29/04; F04C 1/047; F04C 18/0284; F04C 18/0253; F04C 18/0292; F04C 18/07; F04C 29/0007; F04C 29/042; F25B 1/04; F25B 1/10; F25B 1/008
USPC ..... 418/55.1–55.6, 57, 58, 142, 150, 181
See application file for complete search history.

(56) References Cited

U.S. PATENT DOCUMENTS

2017/0204861 A1* 7/2017 Koyama ..... F04C 18/0261
2018/0128270 A1* 5/2018 Koyama ..... F04C 27/005

* cited by examiner $\theta$ =90deg $\theta$ =180deg $\theta$ =270deg

θ =90deg

θ=180deg

θ =270deg

θ =90deg

θ=180deg

θ =270deg

SCROLL COMPRESSOR AND REFRIGERATION CYCLE APPARATUS INCLUDING FIXED SCROLL BASEPLATE INJECTION PORT

TECHNICAL FIELD

The present invention relates to a scroll compressor including an injection port and also relates to a refrigeration cycle apparatus.

BACKGROUND ART

In a conventional air-conditioning apparatus, such as a multi-air-conditioning apparatus for buildings, an outdoor unit (e.g., heat source device) installed outside a building and an indoor unit installed inside the building are connected by pipes to form a refrigerant circuit. The air-conditioning apparatus circulates refrigerant in the refrigerant circuit, heats or cools air using heat rejection or reception by the refrigerant, and thereby heats or cools an air-conditioned space.

Under low outside air temperature conditions (e.g., in cold climates), a scroll compressor used in an air-conditioning apparatus, such as that described above, is difficult to operate because of a high discharge temperature that exceeds an allowable temperature. To allow the scroll compressor to operate under low outside air temperature conditions, appropriate measures need to be taken to reduce the discharge temperature.

Patent Literature 1 discloses a scroll compressor including an injection port. In the technique disclosed in Patent Literature 1, a low-pressure shell scroll compressor is used, in which suction refrigerant is sucked into a compression chamber after being temporarily drawn into the shell, and a tip seal is provided for sealing a spiral tooth tip portion. To reduce the discharge temperature, the scroll compressor has an injection port that is open in a baseplate of a fixed scroll. The injection port serves as the outlet of an injection pipe. Liquid or two-phase refrigerant discharged from the injection pipe passes through the injection port and directly flows into a suction chamber at some rotation phases of a compression mechanism.

CITATION LIST

Patent Literature

Patent Literature 1: Japanese Unexamined Patent Application Publication No. 10-37868

SUMMARY OF INVENTION

Technical Problem

In the technique disclosed in Patent Literature 1, the injection port is positioned to come into contact with the tip seal. Therefore, when interfering with the injection port, the tip seal may be scraped off by the edge portion of the injection port. As a result, compressed refrigerant may leak through the damaged portion of the tip seal, and this may degrade the performance of the scroll compressor. Moreover, an orbiting scroll and a fixed scroll may bite the damaged tip seal, become unable to perform orbiting movement, and cause abnormal stoppage.

The present invention is intended to solve the problems described above. An object of the present invention is to obtain a high-performance, highly reliable scroll compressor capable of preventing a tip seal from being damaged, and to also obtain a refrigeration cycle apparatus.

Solution to Problem

A scroll compressor according to an embodiment of the present invention includes a hermetic container; a compression mechanism disposed in the hermetic container and including a fixed scroll and an orbiting scroll each including a spiral body disposed on a baseplate, the spiral body of the fixed scroll and the spiral body of the orbiting scroll being combined together to form a plurality of chambers including a compression chamber; a motor mechanism configured to drive the orbiting scroll; and a rotation shaft coupled to the orbiting scroll, with the orbiting scroll being eccentric from the motor mechanism, the rotation shaft being configured to transmit torque of the motor mechanism to the orbiting scroll to cause the orbiting scroll to orbit. A tooth tip of the spiral body of the orbiting scroll has a tip seal. The baseplate of the fixed scroll has a first injection port intermittently opened and closed by the tooth tip of the spiral body of the orbiting scroll as the orbiting scroll orbits. The first injection port is open to a suction chamber of the plurality of chambers at some rotation phases, and is located within an angular range defined by a line connecting a winding-end contact point of the orbiting scroll at a compression start phase with a base circle center of the fixed scroll and one of two lines tangent to a winding-end point locus of the tip seal at the tooth tip of the spiral body of the orbiting scroll and passing through the base circle center of the fixed scroll, the one being closer to the winding-end contact point. The first injection port does not interfere with the tip seal at the tooth tip of the spiral body of the orbiting scroll.

A refrigeration cycle apparatus according to another embodiment of the present invention includes a main circuit including the scroll compressor, a condenser, a pressure reducing device, and an evaporator and configured in such a manner that the scroll compressor, the condenser, the pressure reducing device, and the evaporator are sequentially connected by pipes to allow refrigerant to circulate therethrough; and an injection circuit branching off a line between the condenser and the pressure reducing device and connected to the scroll compressor.

Advantageous Effects of Invention

With the scroll compressor and the refrigeration cycle apparatus according to the embodiments of the present invention, the injection port does not interfere with the tip seal. The tip seal is prevented from being scraped off by the edge portion of the injection port, and thus is prevented from being damaged. Therefore, it is possible to obtain a high-performance, highly reliable scroll compressor capable of preventing the tip seal from being damaged and also to obtain a refrigeration cycle apparatus.

DESCRIPTION OF EMBODIMENTS

Figure 1:
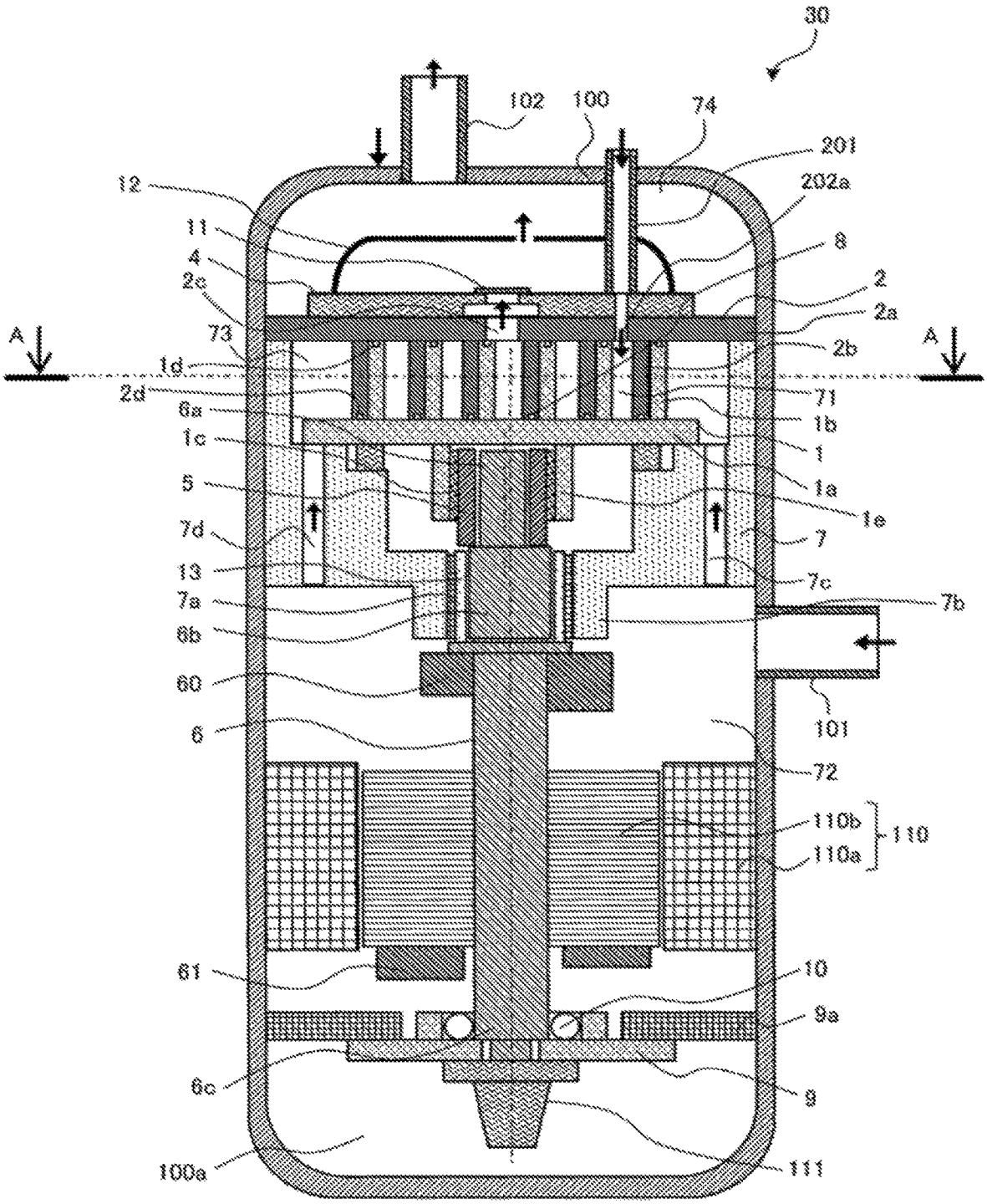
FIG. 1 is a schematic longitudinal cross-sectional view illustrating an overall configuration of a scroll compressor according to Embodiment 1 of the present invention.

Hereinafter, scroll compressors and a refrigeration cycle apparatus according to Embodiments 1 to 6 of the present invention will be described with reference to the drawings. In the drawings to be referred to including FIG. 1, components denoted by the same reference numerals are the same or corresponding ones and are common throughout the following description of Embodiments 1 to 6. Note that constituent elements described throughout the specification are merely examples and are not intended to limit the present invention to those described in the specification.

Embodiment 1

Figure 2:
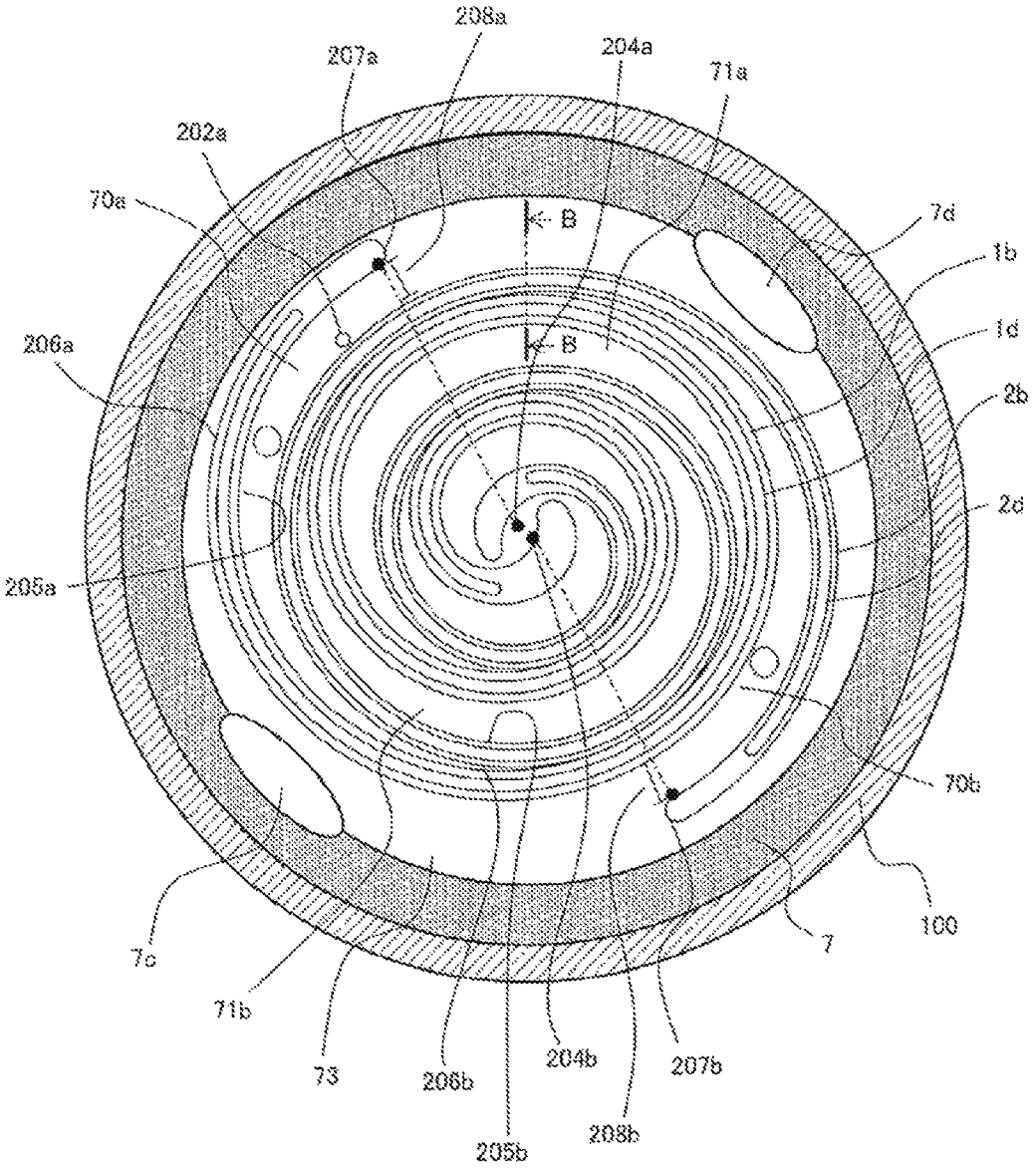
FIG. 2 is a diagram illustrating a compression mechanism and the vicinity thereof in the scroll compressor according to Embodiment 1 of the present invention.

FIG. 1 is a schematic longitudinal cross-sectional view illustrating an overall configuration of a scroll compressor 30 according to Embodiment 1 of the present invention. FIG. 2 is a diagram illustrating a compression mechanism 8 and the vicinity thereof in the scroll compressor 30 according to Embodiment 1 of the present invention.

The scroll compressor 30 of a low-pressure shell type according to Embodiment 1 includes the compression mechanism 8 including an orbiting scroll 1 and a fixed scroll 2. The scroll compressor 30 also includes a motor mechanism 110 configured to drive the compression mechanism 8 through a rotation shaft 6. The scroll compressor 30 contains the compression mechanism 8 and the motor mechanism 110 in a hermetic container 100 that defines an outer structure.

In the hermetic container 100, the rotation shaft 6 is coupled to the orbiting scroll 1, with the orbiting scroll 1 being eccentric from the motor mechanism 110. The rotation shaft 6 is configured to transmit torque of the motor mechanism 110 to the orbiting scroll 1 to cause the orbiting scroll 1 to orbit. The scroll compressor 30 is of a so-called low-pressure shell type that is configured to temporarily draw sucked-in low-pressure refrigerant gas into the internal space of the hermetic container 100 and then compress it.

The hermetic container 100 contains therein a frame 7 and a sub-frame 9 that are disposed in such a manner as to face each other in the axial direction of the rotation shaft 6, with the motor mechanism 110 interposed therebetween. The frame 7 is disposed above the motor mechanism 110 and located between the motor mechanism 110 and the compression mechanism 8. The sub-frame 9 is located below the motor mechanism 110. The frame 7 is secured to the inner periphery of the hermetic container 100 by shrink fitting, welding, or other methods. The sub-frame 9 is secured through a sub-frame holder 9*a* to the inner periphery of the hermetic container 100 by shrink fitting, welding, or other methods.

A pump element 111 including a positive-displacement pump is attached to a lower side of the sub-frame 9 in such a manner that the rotation shaft 6 is removably supported in the axial direction by an upper end face of the pump element 111. The pump element 111 is configured to supply refrigerating machine oil stored in an oil sump 100*a* at the bottom of the hermetic container 100 to a sliding portion, such as a main bearing 7*a* (described below) of the compression mechanism 8.

The hermetic container 100 is provided with a suction pipe 101 for sucking in the refrigerant, a discharge pipe 102 for discharging the refrigerant, and an injection pipe 201.

The compression mechanism 8 has the function of compressing the refrigerant sucked in through the suction pipe 101, and discharging the compressed refrigerant to a high-pressure portion formed in an upper part of the interior of the hermetic container 100.

The compression mechanism 8 includes the orbiting scroll 1 and the fixed scroll 2.

The fixed scroll 2 is secured through the frame 7 to the hermetic container 100. The orbiting scroll 1 is disposed below the fixed scroll 2 and supported by an eccentric shaft portion 6*a* (described below) of the rotation shaft 6 in such a manner as to freely orbit.

The orbiting scroll 1 includes an orbiting baseplate 1*a* and an orbiting spiral body 1*b*, which is a scroll lap disposed upright on the upper surface of the orbiting baseplate 1*a*. The fixed scroll 2 includes a fixed baseplate 2*a* and a fixed spiral body 2*b*, which is a scroll lap disposed upright on the lower surface of the fixed baseplate 2*a*. The orbiting scroll 1 and the fixed scroll 2 are disposed in the hermetic container 100 in a symmetrical spiral shape formed by combining the orbiting spiral body 1*b* and the fixed spiral body 2*b* in opposite phases.

Figure 3:
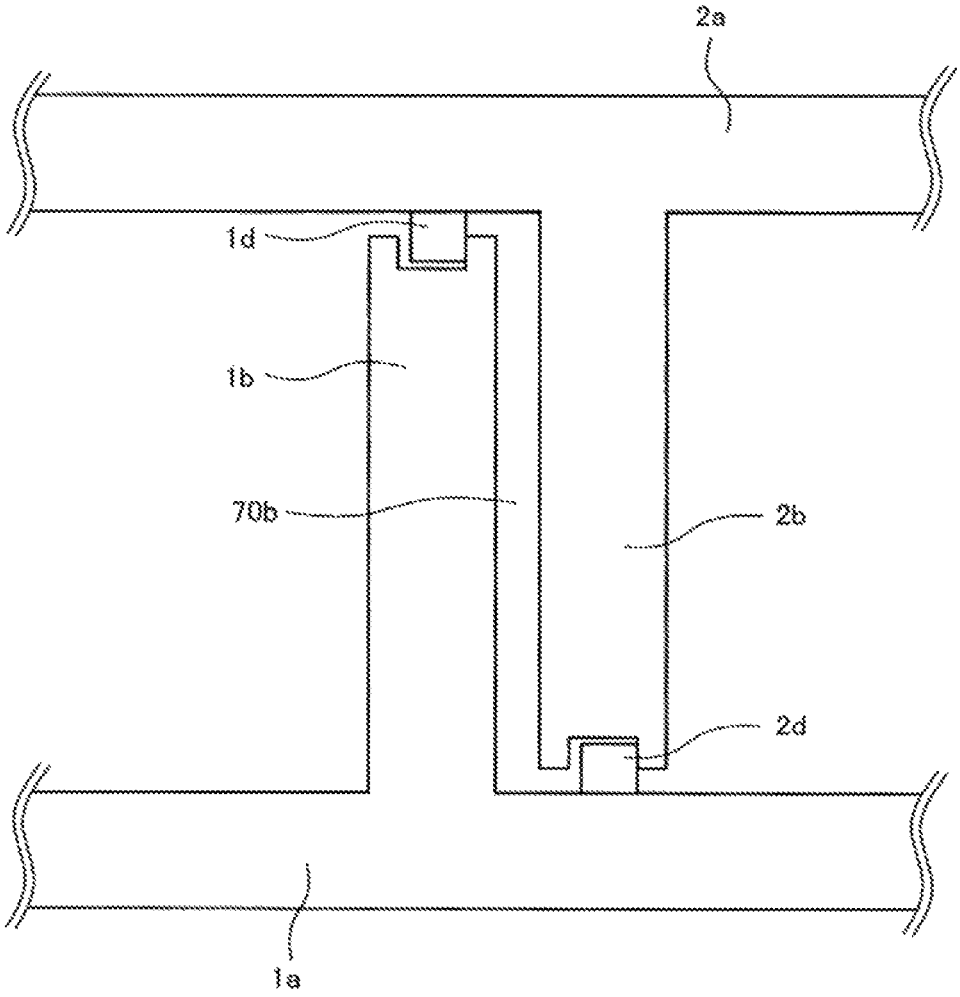
FIG. 3 is a diagram illustrating a cross-section of tip seals and their vicinity in the scroll compressor according to Embodiment 1 of the present invention, taken along line B-B in FIG. 2.

FIG. 3 is a diagram illustrating a cross-section of tip seals 1*d* and 2*d* and their vicinity in the scroll compressor 30 according to Embodiment 1 of the present invention, taken along line B-B in FIG. 2. The tooth tip of the orbiting spiral body 1*b* is provided with the tip seal 1*d* along the spiral direction. The tooth tip of the fixed spiral body 2*b* is provided with the tip seal 2*d* along the spiral direction. The tip seal 1*d* prevents compressed refrigerant from leaking through the gap between the tooth tip of the orbiting spiral body 1*b* and the fixed baseplate 2*a* opposite the tooth tip. Hereinafter, this leakage of refrigerant is referred to as tooth-tip leakage. The tip seal 2*d* prevents tooth-tip leakage through the gap between the tooth tip of the fixed spiral body 2*b* and the orbiting baseplate 1*a* opposite the tooth tip. The tip seals 1*d* and 2*d* are pressed by pressure against the fixed baseplate 2*a* and the orbiting baseplate 1*a*, respectively, to fill in the tooth-tip gap.

The winding end of the tip seal 1*d* is shorter than the winding end of the orbiting spiral body 1*b* of the orbiting scroll 1. The width of the installation groove of the tip seal 1*d* is smaller than the spiral thickness of the orbiting spiral body 1*b* of the orbiting scroll 1. The width of the tip seal 1*d* is smaller than the width of the installation groove of the tip seal 1*d*. Similarly, the winding end of the tip seal 2*d* is shorter than the winding end of the fixed spiral body 2*b* of the fixed scroll 2. The width of the installation groove of the tip seal 2*d* is smaller than the spiral thickness of the fixed spiral body 2*b* of the fixed scroll 2. The width of the tip seal 2*d* is smaller than the width of the installation groove of the tip seal 2*d*.

As described above, the tip seals 1*d* and 2*d* are not provided at winding end portions of the orbiting spiral body 1*b* and the fixed spiral body 2*b*, that is, at portions where there is only a small pressure rise. This is because since there is only limited differential pressure between regions that are adjacent to each other, with a winding end portion therebetween, significant tooth-tip leakage is avoidable even without the tip seals 1*d* and 2*d*. The tip seals 1*d* and 2*d* are preferably soft resin members with high oil absorbency and sliding properties, but are not limited to this.

The center of a base circle of an involute traced by the orbiting spiral body 1*b* is a base circle center 204*a*. The center of a base circle of an involute traced by the fixed spiral body 2*b* is a base circle center 204*b*. As the base circle center 204*a* revolves around the base circle center 204*b*, the orbiting spiral body 1*b* orbits around the fixed spiral body 2*b* as illustrated in FIG. 3 (described below). The movement of the orbiting scroll 1 during operation of the scroll compressor 30 is described in detail later on.

A winding start of the orbiting spiral body 1*b* is an innermost end portion thereof from the base circle center 204*a*, and a winding end of the orbiting spiral body 1*b* is an outermost end portion thereof from the base circle center 204*a*. Similarly, a winding start of the fixed spiral body 2*b* is an innermost end portion thereof from the base circle center 204*b*, and a winding end of the fixed spiral body 2*b* is an outermost end portion thereof from the base circle center 204*b*.

In an inward surface 205*a* of the orbiting spiral body 1*b* of the orbiting scroll 1, a point closest to the winding end and with which an outward surface 206*b* of the fixed spiral body 2*b* of the fixed scroll 2 comes into contact during orbiting movement is a winding-end contact point 207*a*. In an inward surface 205*b* of the fixed spiral body 2*b* of the fixed scroll 2, a point closest to the winding end and with which an outward surface 206*a* of the orbiting spiral body 1*b* of the orbiting scroll 1 comes into contact during orbiting movement is a winding-end contact point 207*b*.

The winding-end contact point 207*a* of the orbiting spiral body 1*b* and the winding-end contact point 207*b* of the fixed spiral body 2*b* are disposed to face each other toward the base circle center 204*a* and the base circle center 204*b*. As illustrated in FIG. 2, from the outside of the spiral, a plurality of pairs of chambers are formed between the orbiting spiral body 1*b* and the fixed spiral body 2*b*.

A suction port 208*a* defines a plane passing through the winding-end contact point 207*a* and a point on the outward surface 206*b* of the fixed spiral body 2*b*, parallel to the vertical direction or the axial direction of the rotation shaft 6, and having the smallest area. A suction port 208*b* defines a plane passing through the winding-end contact point 207*b* and a point on the outward surface 206*a* of the orbiting spiral body 1*b*, parallel to the vertical direction or the axial direction of the rotation shaft 6, and having the smallest area.

A suction chamber 70*a* is defined as a space surrounded by the suction port 208*a*, the inward surface 205*a* of the orbiting spiral body 1*b*, the outward surface 206*b* of the fixed spiral body 2*b*, the orbiting baseplate 1*a*, and the fixed baseplate 2*a*. A suction chamber 70*b* is defined as a space surrounded by the suction port 208*b*, the outward surface 206*a* of the orbiting spiral body 1*b*, the inward surface 205*b* of the fixed spiral body 2*b*, the orbiting baseplate 1*a*, and the fixed baseplate 2*a*.

When the orbiting spiral body 1*b* and the fixed spiral body 2*b* are viewed along the spiral from the suction port 208*a* or suction port 208*b* at the winding end toward the winding start, there is an initial contact portion where the fixed spiral body 2*b* and the orbiting spiral body 1*b* initially come into contact. The suction chamber 70*a* is a space interposed between the initial contact portion and the suction port 208*a*. The suction chamber 70*b* is a space interposed between the initial contact portion and the suction port 208*b*.

In other words, the suction chamber 70*a* is a space where the winding-end contact point 207*a* is spaced apart from the outward surface 206*b* of the fixed spiral body 2*b* to form the suction port 208*a*. Also, the suction chamber 70*b* is a space where the winding-end contact point 207*b* is spaced apart from the outward surface 206*a* of the orbiting spiral body 1*b* to form the suction port 208*b*.

As described below, when the orbiting spiral body 1*b* rotates, the positions where the fixed spiral body 2*b* and the orbiting spiral body 1*b* are in contact are moved and the width of the suction port 208*a* or suction port 208*b* is changed. The volume of the suction chamber 70*a* and the suction chamber 70*b* is thus changed by the rotation. Note that the suction ports 208*a* and 208*b* are opening ports and the suction chambers 70*a* and 70*b* are open chambers. This means that the suction chambers 70*a* and 70*b* are chambers where there is little change in pressure.

A compression chamber 71*a* is defined as a space surrounded by the inward surface 205*a* of the orbiting spiral body 1*b*, the outward surface 206*b* of the fixed spiral body 2*b*, the orbiting baseplate 1*a*, and the fixed baseplate 2*a*. A compression chamber 71*b* is defined as a space surrounded by the outward surface 206*a* of the orbiting spiral body 1*b*, the inward surface 205*b* of the fixed spiral body 2*b*, the orbiting baseplate 1*a*, and the fixed baseplate 2*a*.

When the orbiting spiral body 1*b* and the fixed spiral body 2*b* are viewed along the spiral from the suction port 208*a* or suction port 208*b* at the winding end toward the winding start, there are contact portions where the fixed spiral body 2*b* and the orbiting spiral body 1*b* are in contact. The compression chambers 71*a* and 71*b* are spaces each interposed between two of the contact portions.

As described below, when the orbiting spiral body 1*b* rotates, the positions where the fixed spiral body 2*b* and the orbiting spiral body 1*b* are in contact are moved and the volume of the compression chambers 71*a* and 71*b* is changed by the rotation.

Note that the compression chambers 71*a* and 71*b* are closed spaces and vary in volume. The compression chambers 71*a* and 71 *b* are thus chambers in which the pressure varies as the rotation shaft 6 rotates.

That is, in the state illustrated in FIG. 2, the outermost chambers are the suction chambers 70*a* and 70*b* and the remaining chambers are the compression chambers 71*a* and 71*b*. As described above, the orbiting scroll 1 includes the orbiting spiral body 1*b* disposed on the orbiting baseplate 1*a*, and the fixed scroll 2 includes the fixed spiral body 2*b* disposed on the fixed baseplate 2*a*. The orbiting spiral body 1*b* of the orbiting scroll 1 and the fixed spiral body 2*b* of the fixed scroll 2 are combined together to form a plurality of chambers including the compression chambers 71*a* and 71*b*.

A baffle 4 is secured to a surface of the fixed baseplate 2*a* of the fixed scroll 2 opposite the orbiting scroll 1. The baffle 4 has a through hole open to a discharge port 2*c* of the fixed scroll 2, and the through hole is provided with a discharge valve 11. A discharge muffler 12 is mounted in such a manner as to cover the discharge port 2*c*.

The fixed scroll 2 is secured to the frame 7. The frame 7 has a thrust surface that axially supports a thrust force acting on the orbiting scroll 1. The frame 7 has cavities 7*c* and 7*d* for introducing refrigerant sucked through the suction pipe 101 into the compression mechanism 8. The cavities 7*c* and 7*d* pass through the frame 7 from the lower surface to the upper surface of the frame 7.

The motor mechanism 110 that supplies a rotary drive force to the rotation shaft 6 includes a motor stator 110*a* and a motor rotor 110*b*. To obtain power from the outside, the motor stator 110*a* is connected by a lead wire (not shown) to a glass terminal (not shown) located between the frame 7 and the motor stator 110*a*. The motor rotor 110*b* is secured to the rotation shaft 6 by shrink fitting or other methods. For balancing the entire rotation system of the scroll compressor 30, a first balance weight 60 is secured to the rotation shaft 6 and a second balance weight 61 is secured to the motor rotor 110*b*.

The rotation shaft 6 includes the eccentric shaft portion 6*a* in the upper part of the rotation shaft 6, a main shaft portion 6*b*, and a sub-shaft portion 6*c* in the lower part of the rotation shaft 6. The orbiting scroll 1 is fitted to the eccentric shaft portion 6*a*, with a slider 5 and an orbiting bearing 1*c* interposed therebetween, so that the eccentric shaft portion 6*a* and the orbiting bearing 1*c* slide with respect to each other, with a film of refrigerating machine oil therebetween. The orbiting bearing 1*c* is secured inside a boss 1*e*, for example, by press-fitting a bearing material (e.g., copper lead alloy) used for slide bearings, and the orbiting scroll 1 orbits as the rotation shaft 6 rotates. The main shaft portion 6*b* is fitted into a main bearing 7*a*, with a sleeve 13 interposed therebetween. The main bearing 7*a* is disposed on the inner periphery of a boss 7*b* of the frame 7. The main shaft portion 6*b* and the main bearing 7*a* slide with respect to each other, with a film of refrigerating machine oil therebetween. The main bearing 7*a* is secured inside the boss 7*b*, for example, by press-fitting a bearing material (e.g., copper lead alloy) used for slide bearings.

A sub-bearing 10 formed by a ball bearing is disposed on the upper side of the sub-frame 9. Under the motor mechanism 110, the sub-bearing 10 rotatably supports the rotation shaft 6 in the radial direction. The sub-bearing 10 may rotatably support the rotation shaft 6 with a bearing configuration other than the ball bearing. The sub-shaft portion 6*c* is fitted into the sub-bearing 10, and the sub-shaft portion 6*c* and the sub-bearing 10 slide with respect to each other. The axial center of the main shaft portion 6*b* and sub-shaft portion 6*c* coincides with the axial center of the rotation shaft 6.

In Embodiment 1, spaces formed by orbiting movement of a scroll compression element, such as the compression mechanism 8, are defined as follows. That is, a housing space located in the hermetic container 100 and closer to the motor rotor 110*b* than the frame 7 is, is a first space 72; a space formed by the inner wall of the frame 7 and the fixed baseplate 2*a* is a second space 73; and a space closer to the discharge pipe 102 than the fixed baseplate 2*a* is, is a third space 74.

Figure 4A:
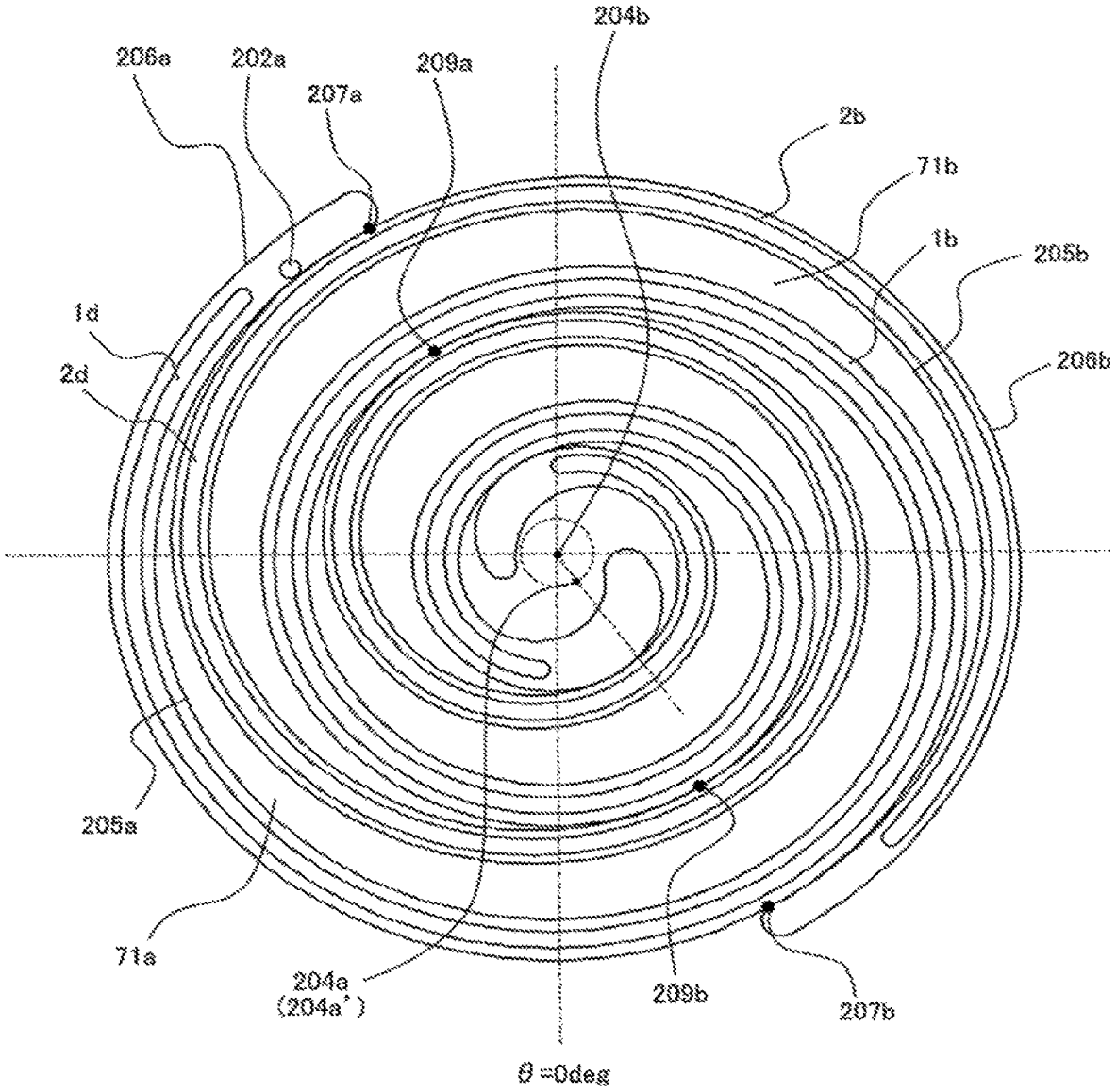
FIG. 4A is a compression process diagram illustrating an operation at θ=0 degrees in one rotation of an orbiting spiral body in a cross-section of the scroll compressor according to Embodiment 1 of the present invention, taken along line A-A in FIG. 1.
Figure 4B:
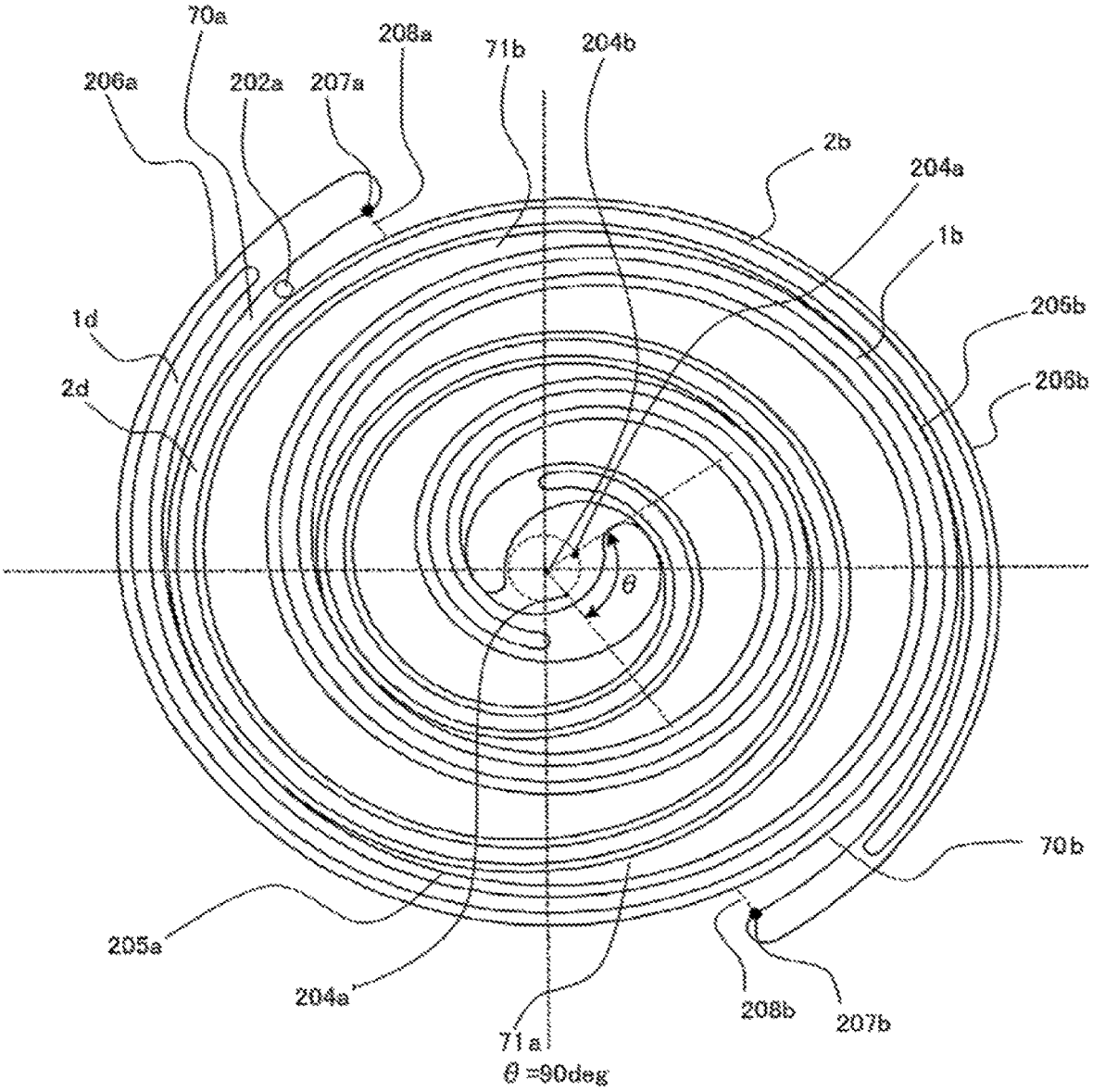
FIG. 4B is a compression process diagram illustrating an operation at θ=90 degrees in one rotation of the orbiting spiral body in the cross-section of the scroll compressor according to Embodiment 1 of the present invention, taken along line A-A in FIG. 1.
Figure 4C:
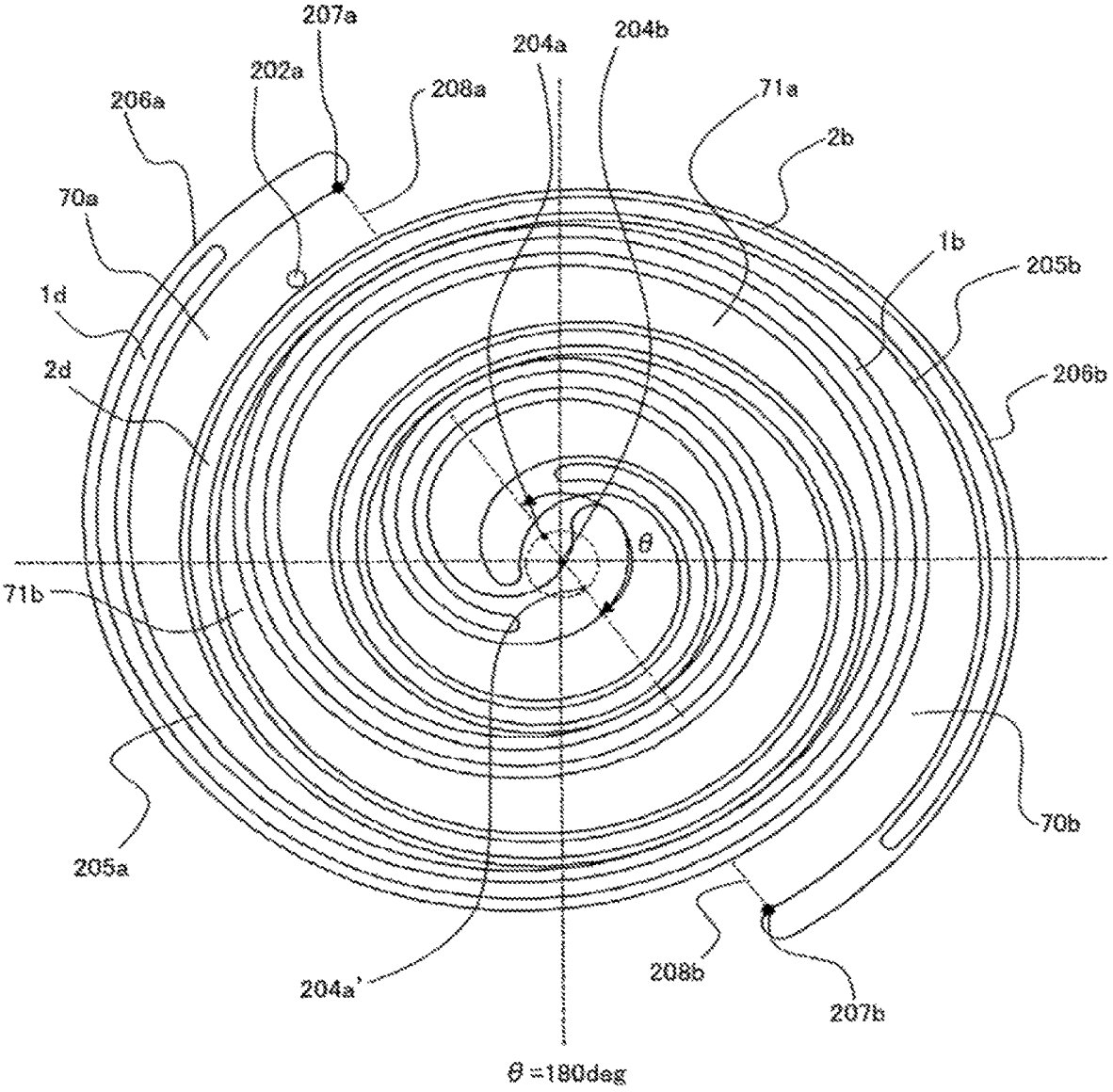
FIG. 4C is a compression process diagram illustrating an operation at θ=180 degrees in one rotation of the orbiting spiral body in the cross-section of the scroll compressor according to Embodiment 1 of the present invention, taken along line A-A in FIG. 1.
Figure 4D:
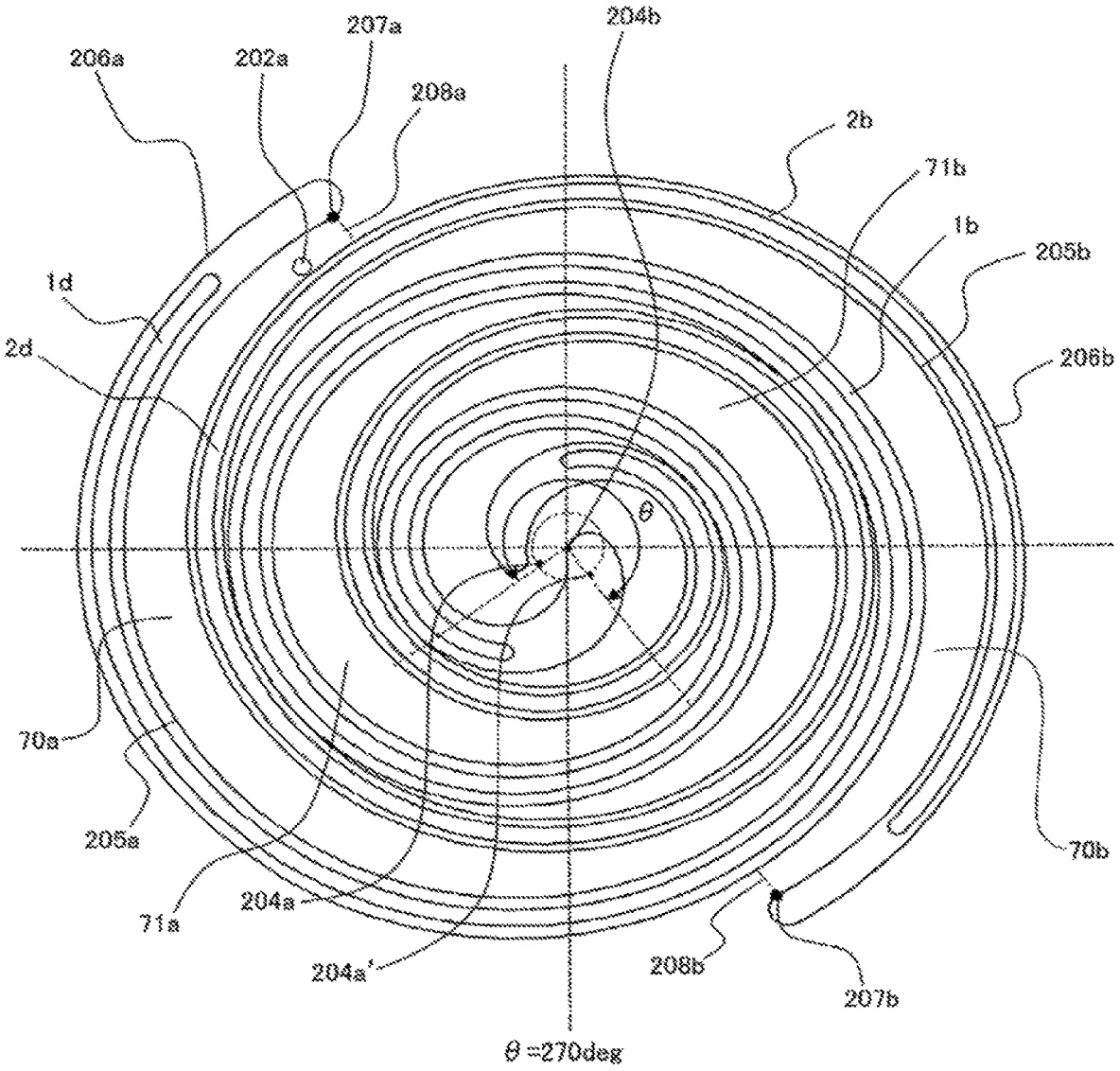
FIG. 4D is a compression process diagram illustrating an operation at θ=270 degrees in one rotation of the orbiting spiral body in the cross-section of the scroll compressor according to Embodiment 1 of the present invention, taken along line A-A in FIG. 1.

Operations of the compression mechanism 8 will now be described using FIGS. 4A to 4D. FIG. 4A is a compression process diagram illustrating an operation at θ=0 degrees in one rotation of the orbiting spiral body 1*b* in a cross-section of the scroll compressor 30 according to Embodiment 1 of the present invention, taken along line A-A in FIG. 1. FIG. 4B is a compression process diagram illustrating an operation at θ=90 degrees in one rotation of the orbiting spiral body 1*b* in the cross-section of the scroll compressor 30 according to Embodiment 1 of the present invention, taken along line A-A in FIG. 1. FIG. 4C is a compression process diagram illustrating an operation at θ=180 degrees in one rotation of the orbiting spiral body 1*b* in the cross-section of the scroll compressor 30 according to Embodiment 1 of the present invention, taken along line A-A in FIG. 1. FIG. 4D is a compression process diagram illustrating an operation at θ=270 degrees in one rotation of the orbiting spiral body 1*b* in the cross-section of the scroll compressor 30 according to Embodiment 1 of the present invention, taken along line A-A in FIG. 1.

A rotation phase θ is defined as an angle formed by a line connecting a base circle center of the orbiting spiral body 1*b* at the beginning of compression (i.e., base circle center 204*a*') with the base circle center 204*b* of the fixed spiral body 2*b* and a line connecting the base circle center 204*a* of the orbiting spiral body 1*b* at specific timing with the base circle center 204*b* of the fixed spiral body 2*b*. That is, the rotation phase θ is 0 degrees at the beginning of compression, and changes from 0 degrees to 360 degrees. FIGS. 4A to 4D illustrate how the orbiting spiral body 1*b* orbits as the rotation phase θ changes in the following order: 0 degrees→90 degrees→180 degrees→270 degrees.

When current is applied to the glass terminal (not shown) of the hermetic container 100, the motor rotor 110*b* causes the rotation shaft 6 to rotate. The torque of the motor rotor 110*b* is transmitted through the eccentric shaft portion 6*a* to the orbiting bearing 1*c*, further transmitted from the orbiting bearing 1*c* to the orbiting scroll 1, and causes the orbiting scroll 1 to orbit. Refrigerant gas sucked through the suction pipe 101 into the hermetic container 100 is supplied through the first space 72 and the cavities 7*c* and 7*d* to the second space 73, and drawn into the suction chambers 70*a* and 70*b*.

In the state of FIG. 4A, where the outermost chambers are closed and suction of the refrigerant is completed, all chambers including the outermost chambers are the compression chambers 71*a* and 71*b*. In this case, when focusing on the compression chambers 71*a* and 71*b*, which are outermost chambers, the compression chambers 71*a* and 71*b* decrease in volume while moving in the direction from the outer periphery toward the center as the orbiting scroll 1 orbits. The refrigerant gas in the compression chambers 71*a* and 71*b* is compressed as the volume of the compression chambers 71*a* and 71*b* decreases.

Typically, in the scroll compressor 30, in the direction from the ends of the orbiting spiral body 1*b* and the fixed spiral body 2*b* on the outer periphery side toward the spiral center along the involute, the two spiral bodies, the orbiting spiral body 1*b* and the fixed spiral body 2*b*, come into contact with each other at a plurality of contact points. As illustrated in FIG. 4A, when the winding-end contact point 207*a* is in contact with the outward surface 206*b*, suction of the refrigerant is completed. Also, when the winding-end contact point 207*b* is in contact with the outward surface 206*a*, suction of the refrigerant is completed. At this time point, the suction ports 208*a* and 208*b* are closed and the outermost chambers are not the suction chambers 70*a* and 70*b*.

As illustrated in FIG. 4A, at the completion of suction, a space extending from the winding-end contact point 207*a*, which is the first contact point between the inward surface 205*a* of the orbiting spiral body 1*b* and the outward surface 206*b* of the fixed spiral body 2*b*, to a second contact point 209*a* is a closed space. Also, at the completion of suction, a space extending from the winding-end contact point 207*b*, which is the first contact point between the outward surface 206*a* of the orbiting spiral body 1*b* and the inward surface 205*b* of the fixed spiral body 2*b*, to a second contact point 209*b* is a closed space. However, when the suction ports 208*a* and 208*b* slightly open immediately before or after completion of suction, the contact points 209*a* and 209*b*, which are second from the outside at the completion of suction, become the outermost contact points and the suction ports 208*a* and 208*b* open.

The suction chambers 70*a* and 70*b* are spaces that are varied in volume by rotation of the orbiting spiral body 1*b*. That is, as the rotation phase θ increases, the suction chambers 70*a* and 70*b* increase in volume along respective directions of lines substantially tangent to the orbiting spiral body 1*b* and the fixed spiral body 2*b*, as illustrated in FIG. 4B FIG. 4C FIG. 4D. When the suction ports 208*a* and 208*b* disappear and the volume of the suction chambers 70*a* and 70*b* is maximized at the time point of FIG. 4A, the suction chambers 70*a* and 70*b* transition to the compression chambers 71*a* and 71*b*.

Because of the spiral shape, the compression chambers 71*a* and 71*b* decrease in volume toward the center, vary in volume as the rotation shaft 6 rotates as described above, and compress the refrigerant sucked in the compression chambers 71*a* and 71*b*.

The compression chambers 71*a* and 71 *b* closest to the center communicate with the discharge port 2*c* illustrated in FIG. 1. The compressed refrigerant is discharged from the discharge port 2*c* through the discharge valve 11 into the discharge muffler 12, and is then discharged into the third space 74.

An injection port 202*a*, which is a feature of the present invention, will now be described with reference to FIGS. 1 and 2. The fixed baseplate 2*a* is provided with the injection port 202*a* formed by making a hole toward the suction chamber 70*a*. From the outside of the scroll compressor 30, liquid or two-phase refrigerant flows through the injection pipe 201 into the injection port 202*a*. The injection port 202*a* is formed by making a hole such that it opens only to the suction chamber 70*a* during one rotation. The injection port 202*a* corresponds to a first injection port of the present invention.

The injection port 202*a* is provided in the vicinity of the winding end portion of the orbiting spiral body 1*b*, outside the winding end of the tip seal 1*d*.

The injection port 202*a* formed in the fixed baseplate 2*a* is repeatedly opened and closed as the rotation shaft 6 rotates, by an end portion of the orbiting spiral body 1*b* adjacent to the fixed baseplate 2*a* (i.e., by a tooth tip that is an end portion of the orbiting spiral body 1*b* in the axial direction of the rotation shaft 6). When the width of the injection port 202*a* is smaller than the spiral body thickness of the orbiting spiral body 1*b*, the injection port 202*a* is completely closed in a given range of rotation angle of the rotation shaft 6. Here, the spiral body thickness of the orbiting spiral body 1*b* is the nearest distance between the inward surface 205*a* and the outward surface 206*a* defined by the involute of the orbiting spiral body 1*b*.

In all phases of rotation of the rotation shaft 6, the injection port 202*a* is located inside the outermost surface of a structure formed by combining together the orbiting spiral body 1*b* and the fixed spiral body 2*b* of the compression mechanism 8.

In the drawings to be referred to, the injection port 202*a* is always indicated by an open circle to clarify its position, regardless of the positional relation with the orbiting spiral body 1*b*.

The tooth tip of the orbiting spiral body 1*b* (i.e., end portion of the orbiting spiral body 1*b* in the axial direction of the rotation shaft 6) and the fixed baseplate 2*a* facing the tooth tip are in contact in such a manner that they slide with respect to each other. At the same time, the tooth tip of the fixed spiral body 2*b* (i.e., end portion of the fixed spiral body 2*b* in the axial direction of the rotation shaft 6) and the orbiting baseplate 1*a* facing the tooth tip are in contact in such a manner that they slide with respect to each other. With this configuration, the suction chambers 70*a* and 70*b* and the compression chambers 71*a* and 71*b* are sealed. The orbiting spiral body 1*b* and the fixed spiral body 2*b* are formed to an appropriate thickness to ensure strength, and the tooth tip portion of each of the orbiting spiral body 1*b* and the fixed spiral body 2*b* for sealing has a flat surface having a width corresponding to the spiral body thickness.

Figure 5A:
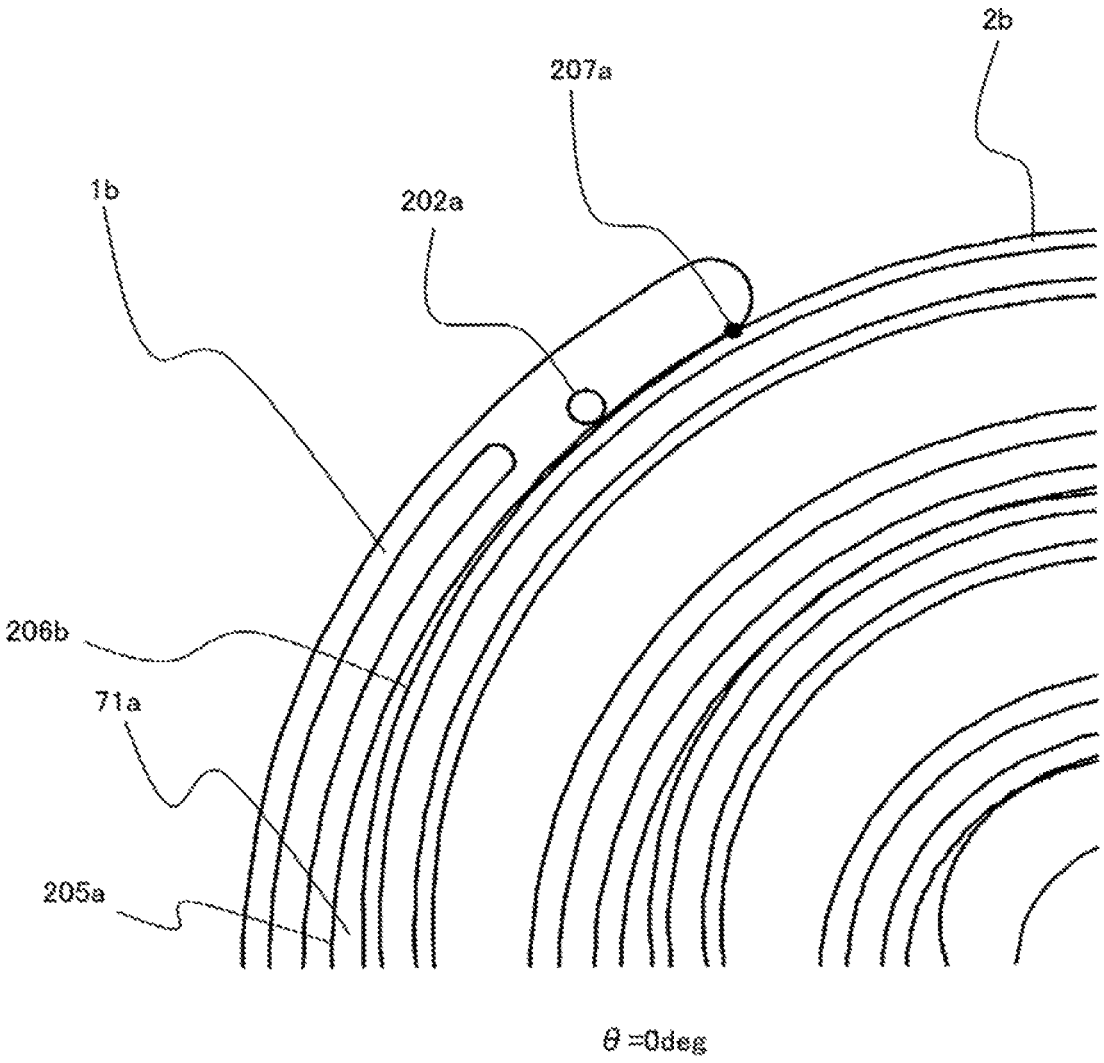
FIG. 5A is a compression process diagram illustrating an operation at θ=0 degrees in one rotation of the orbiting spiral body in the vicinity of an injection port in the cross-section of the scroll compressor according to Embodiment 1 of the present invention, taken along line A-A in FIG. 1.
Figure 5B:
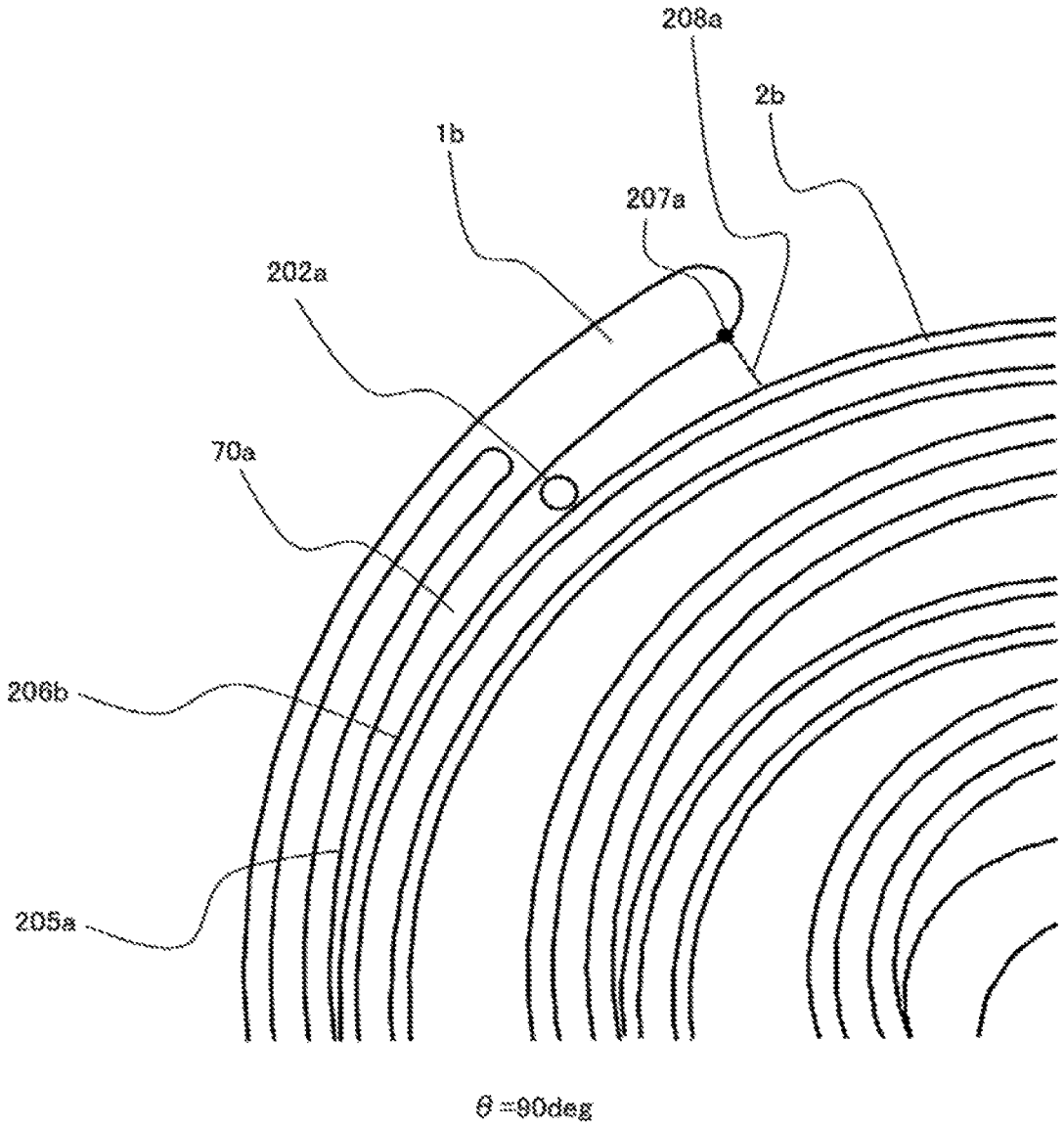
FIG. 5B is a compression process diagram illustrating an operation at θ=90 degrees in one rotation of the orbiting spiral body in the vicinity of the injection port in the cross-section of the scroll compressor according to Embodiment 1 of the present invention, taken along line A-A in FIG. 1.
Figure 5C:
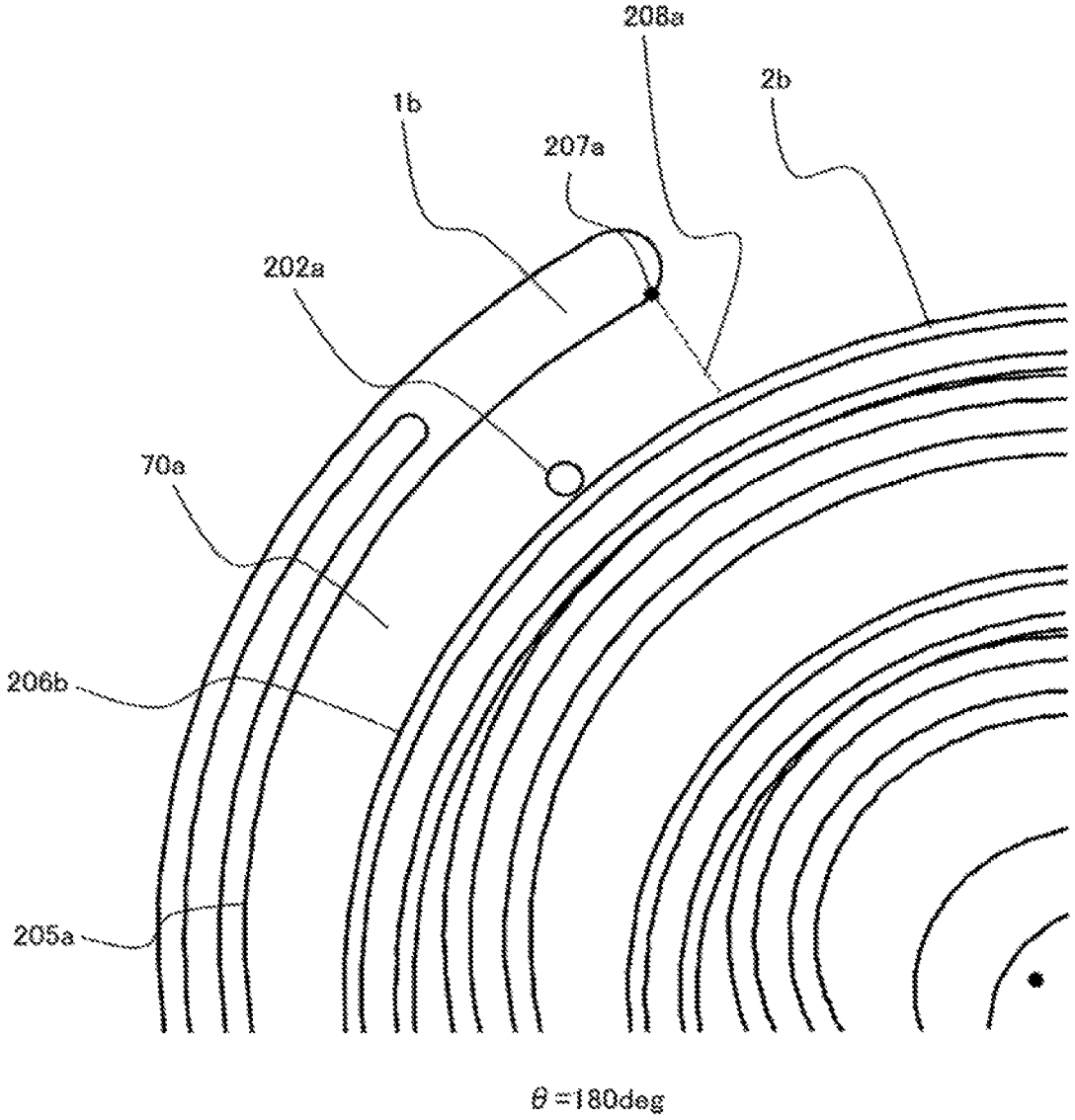
FIG. 5C is a compression process diagram illustrating an operation at θ=180 degrees in one rotation of the orbiting spiral body in the vicinity of the injection port in the cross-section of the scroll compressor according to Embodiment 1 of the present invention, taken along line A-A in FIG. 1.
Figure 5D:
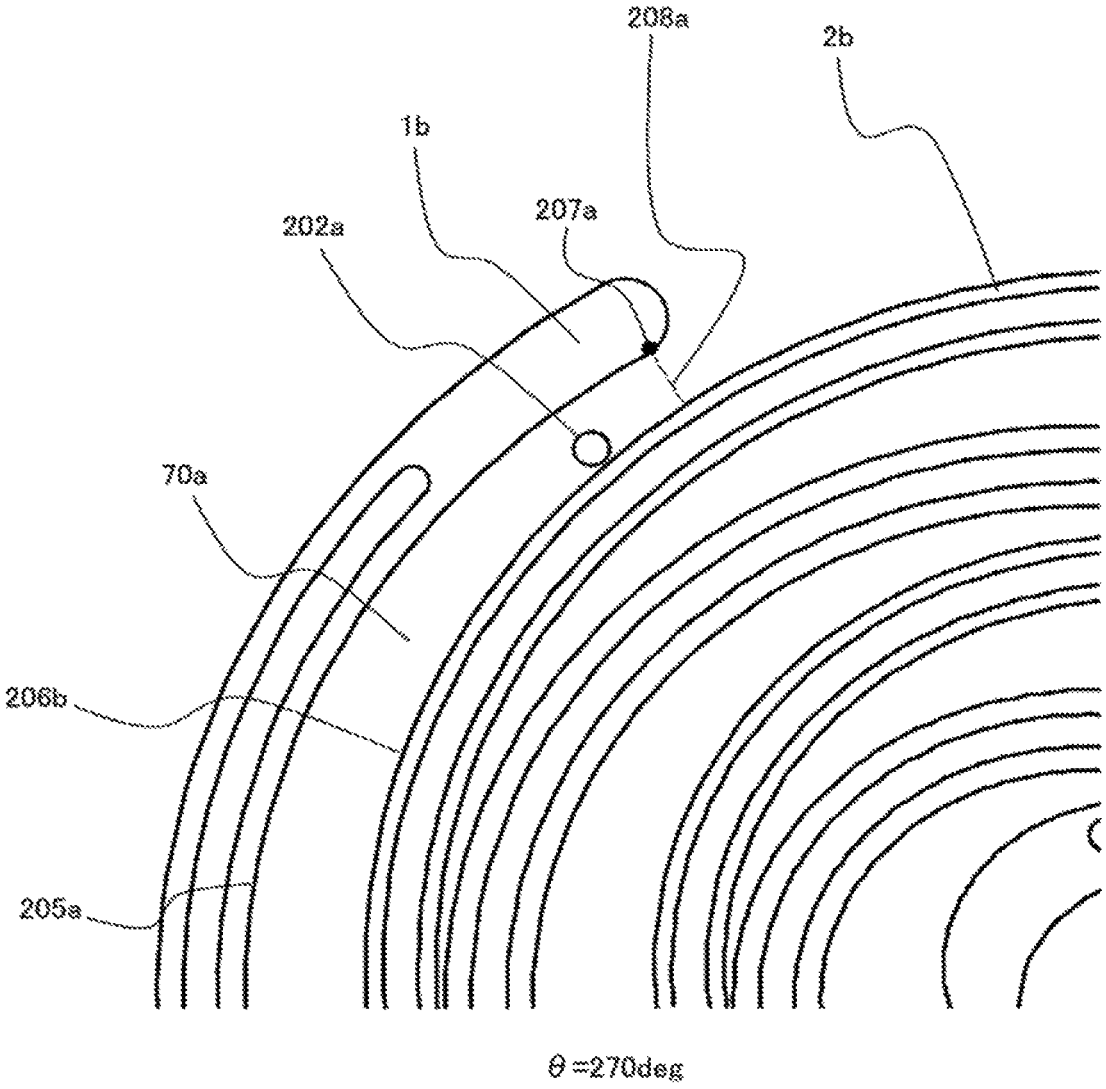
FIG. 5D is a compression process diagram illustrating an operation at θ=270 degrees in one rotation of the orbiting spiral body in the vicinity of the injection port in the cross-section of the scroll compressor according to Embodiment 1 of the present invention, taken along line A-A in FIG. 1.
Figure 6:
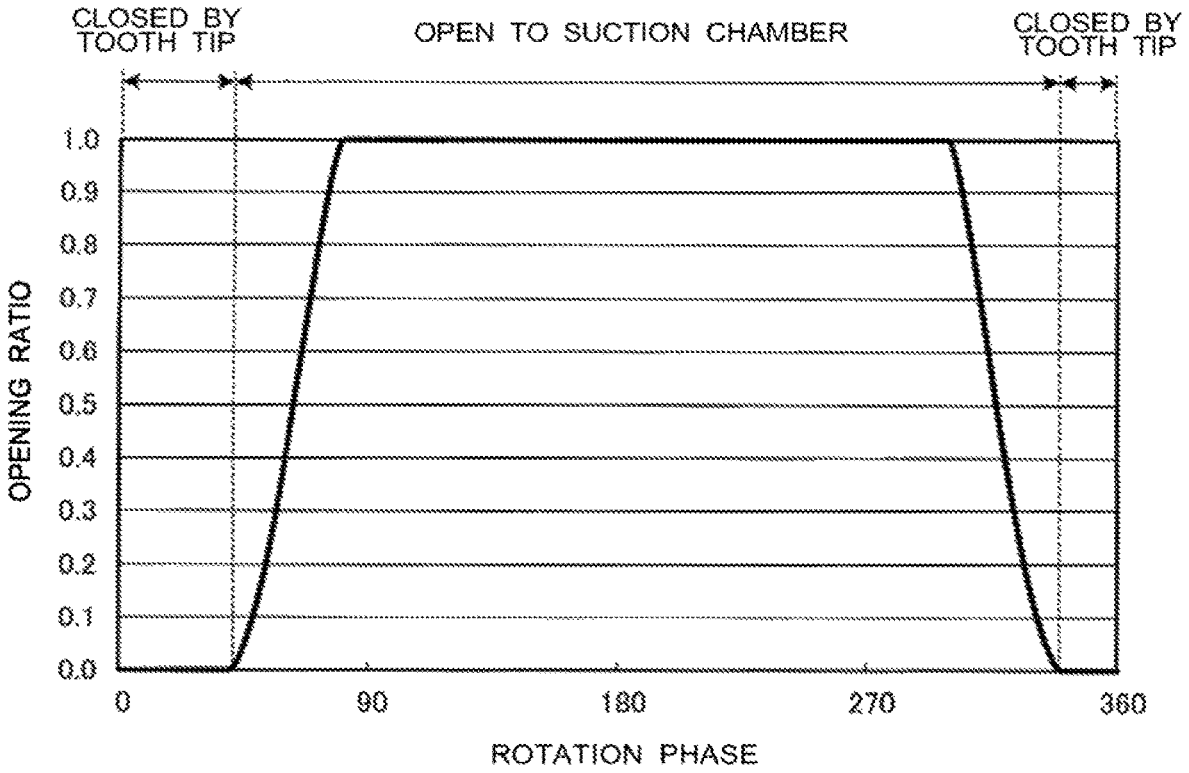
FIG. 6 is a diagram illustrating an injection port opening ratio in the scroll compressor according to Embodiment 1 of the present invention.

With reference to FIGS. 5A to 5D and FIG. 6, the operation of opening and closing the injection port 202*a* will be described. FIG. 5A is a compression process diagram illustrating an operation at θ=0 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 5B is a compression process diagram illustrating an operation at θ=90 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 5C is a compression process diagram illustrating an operation at θ=180 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 5D is a compression process diagram illustrating an operation at θ=270 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 6 is a diagram illustrating an injection port opening ratio in the scroll compressor 30 according to Embodiment 1 of the present invention.

The opening ratio of the injection port 202*a* is the ratio of the area of the injection port 202*a* open to the suction chamber 70*a*, to the total area of the injection port 202*a*.

At the rotation phase θ=0 degrees, the injection port 202*a* is completely closed by the orbiting spiral body 1*b* as illustrated in FIG. 5A. The outermost chamber at this time point is the compression chamber 71*a*. As the rotation phase advances, the injection port 202*a* begins to open to the suction chamber 70*a* at around the rotation phase θ=40 degrees. Then, the opening ratio gradually increases and the injection port 202*a* completely opens at around the rotation phase θ=80 degrees. The rotation phase θ further advances, and the injection port 202*a* is completely closed by the orbiting spiral body 1*b* at around the rotation phase θ=340 degrees. At the rotation phases θ=90 degrees, 180 degrees, and 270 degrees, as illustrated in FIGS. 5B, 5C, and 5D, the injection port 202*a* are completely open to the suction chamber 70*a*. The same operation as above is repeated at the rotation phase θ=360 degrees and thereafter.

That is, the injection port 202*a* is open only when the winding-end contact point 207*a* of the orbiting spiral body 1*b* is spaced apart from the fixed spiral body 2*b* to form the suction chamber 70*a*, as the orbiting scroll 1 orbits.

Also, as the orbiting scroll 1 orbits, the injection port 202*a* is closed by being covered with the tooth tip of the orbiting spiral body 1*b* of the orbiting scroll 1 while the winding-end contact point 207*a* of the orbiting spiral body 1*b* is in contact with the fixed spiral body 2*b*.

Figure 7:
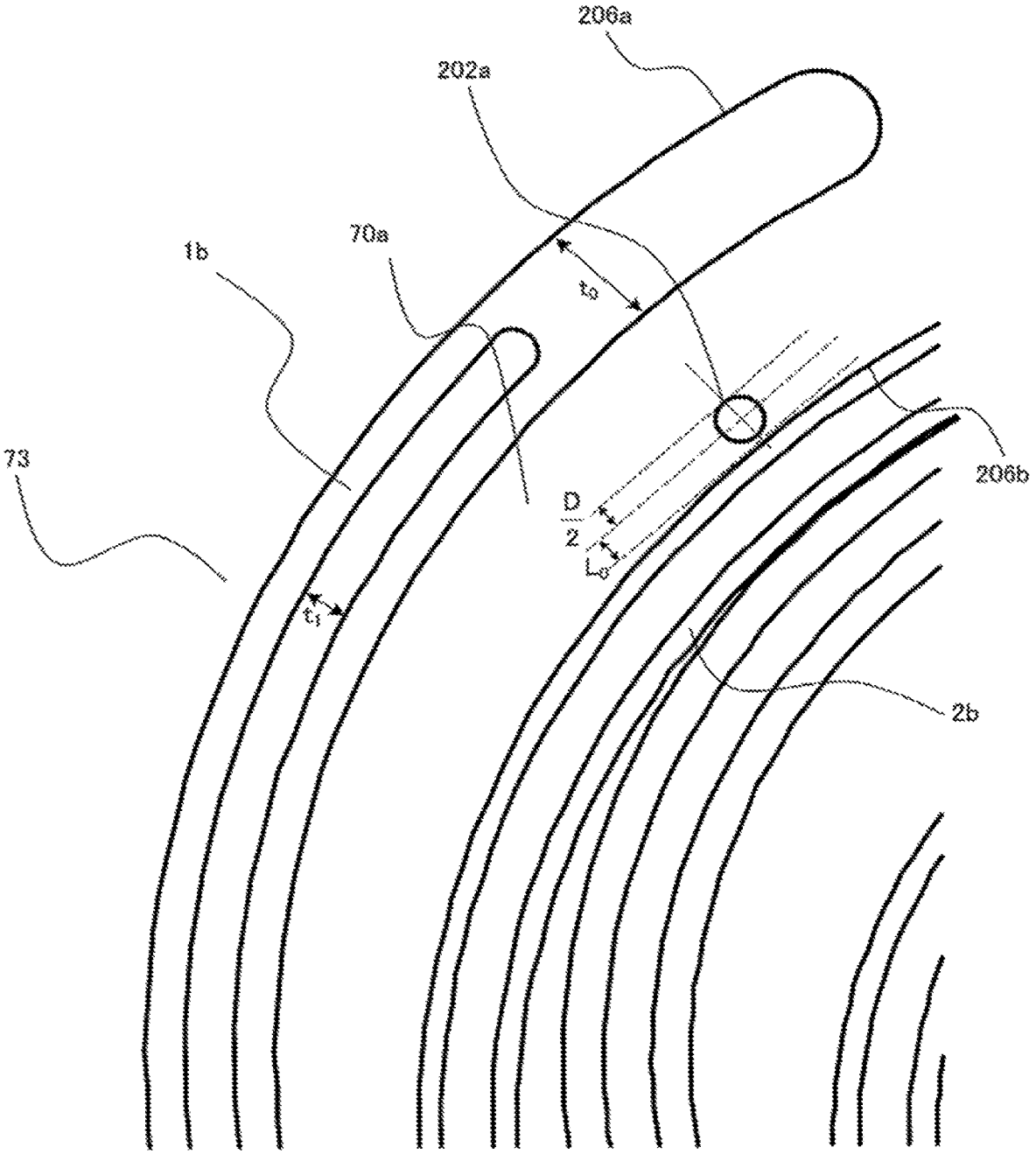
FIG. 7 is a diagram illustrating an injection port installation position in the scroll compressor according to Embodiment 1 of the present invention.

The installation position of the injection port 202*a* will now be described. FIG. 7 is a diagram illustrating an installation position of the injection port 202*a* in the scroll compressor 30 according to Embodiment 1 of the present invention. FIG. 7 is an enlarged view of the injection port 202*a* open to the suction chamber 70*a* and its neighboring area.

A position that is radially outside the outward surface 206*a* of the orbiting spiral body 1*b* forming the outermost chamber is located in the second space 73. The second space 73 is a region serving neither as the suction chamber 70*a* nor as the compression chamber 71*a* during one rotation of the rotation shaft 6. Therefore, if an injection port is located in the second space 73, the injection port passes across the orbiting spiral body 1*b* and injection refrigerant leaks to the second space 73 in a given rotation phase θ in one rotation. In horizontal plan view, therefore, the injection port 202*a* should not cross the outward surface 206*a* of the orbiting spiral body 1*b* in any rotation phase θ of the rotation shaft 6. Thus, inequality (1) "$D<2(t_0-L_0)$" needs to be satisfied, where D is the outside diameter of the injection port 202*a*, $L_0$ is the distance of the center of the injection port 202*a* from the outward surface 206*b* of the fixed spiral body 2*b*, and $t_0$ is the spiral body thickness of the orbiting spiral body 1*b*.

To ensure a necessary and sufficient amount of injection, it is preferable to satisfy inequality (2) "$(t_0-t_1)/2<D$", where $t_1$ is the tip seal width of the orbiting spiral body 1*b*.

Figure 8:
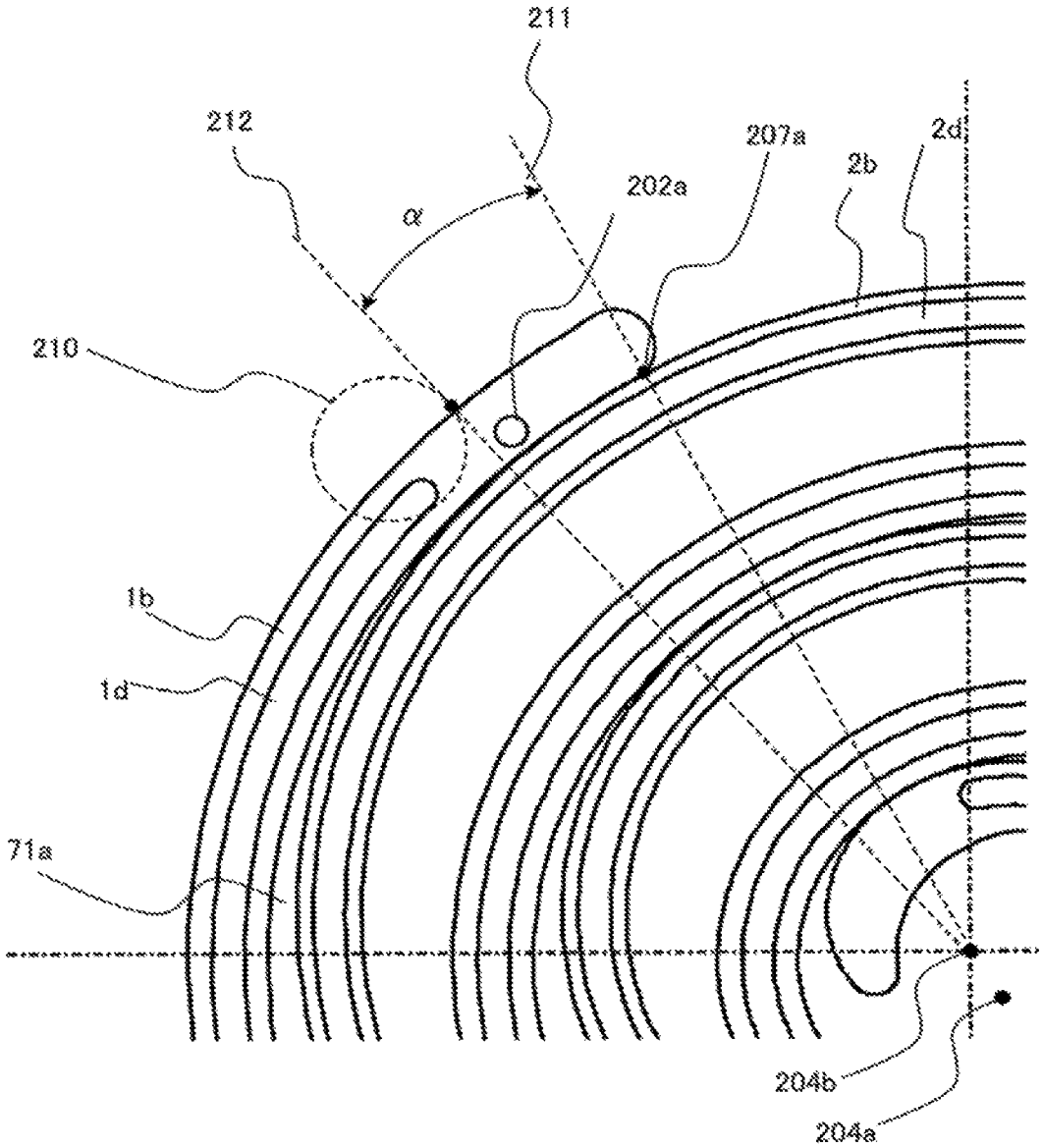
FIG. 8 is a diagram illustrating an injection port installation angle in the scroll compressor according to Embodiment 1 of the present invention.

The range of an installation angle α of the injection port 202*a* will now be described. FIG. 8 is a diagram illustrating the installation angle α of the injection port 202*a* in the scroll compressor 30 according to Embodiment 1 of the present invention.

The installation angle α of the injection port 202*a* is an angle formed by a line 211 connecting the winding-end contact point 207*a* at the rotation phase θ=0 degrees with the base circle center 204*b* and a line 212. Of two lines tangent to a winding-end point locus 210 of the tip seal 1*d* at the tooth tip of the orbiting spiral body 1*b* and passing through the base circle center 204*b*, the line 212 is one that is closer to the winding-end contact point 207*a*. The winding-end angle of the tip seal 1*d* needs to be set such that the length of a section of a line passing through the winding-end contact point 207*a* at the rotation phase θ=0 degrees and tangent to the outward surface 206*b* of the fixed spiral body 2*b*, the section being between the line 211 and the line 212, is longer than the diameter of the injection port 202*a*. By providing the injection port 202*a* within the installation angle α, the injection port 202*a* is prevented from interfering with the tip seal 1*d*. The tip seal 1*d* is thus prevented from being damaged by the edge portion of the injection port 202*a*.

The interference of the injection port 202*a* with the tip seal 1*d* means that as viewed from the axial direction of the rotation shaft 6, the tip seal 1*d* at the tooth tip of the orbiting spiral body 1*b* overlaps the injection port 202*a* in the horizontal direction. This interference creates an area where the tip seal 1*d* is not in contact with the surface of the fixed baseplate 2*a*.

If an injection port is provided at an angular position larger than the installation angle α, the outside diameter of the injection port is inevitably reduced to prevent the injection port from interfering with the tip seal 1*d*. In this case, it is difficult to increase the amount of injection from the injection port.

Figure 9:
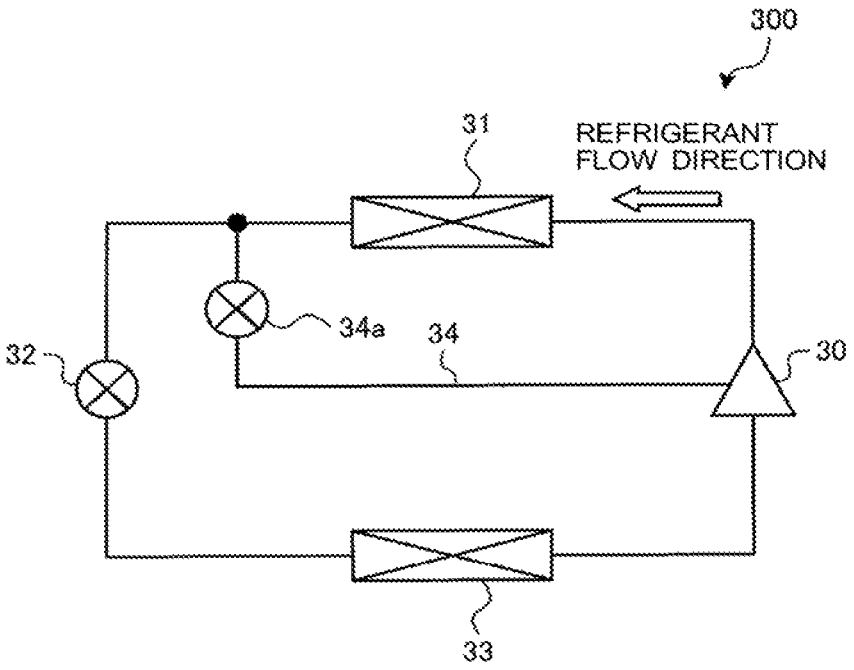
FIG. 9 illustrates a refrigeration cycle apparatus including an injection circuit that includes the scroll compressor according to Embodiment 1 of the present invention.

FIG. 9 illustrates a refrigeration cycle apparatus 300 including an injection circuit 34 that includes the scroll compressor 30 according to Embodiment 1 of the present invention.

The refrigeration cycle apparatus 300 illustrated in FIG. 9 includes a circuit including the scroll compressor 30, a condenser 31, an expansion valve 32 serving as a pressure reducing device, and an evaporator 33 and configured in such a manner that these components are sequentially connected by pipes to allow refrigerant to circulate therethrough.

The refrigeration cycle apparatus 300 also includes the injection circuit 34 that branches off the line between the condenser 31 and the expansion valve 32 and is connected to the injection port 202*a* in the scroll compressor 30. The injection circuit 34 includes an expansion valve 34*a* serving as a flow control valve, and is capable of controlling the flow rate of injection into the suction chamber 70*a*.

The opening degree of the expansion valve 32, the opening degree of the expansion valve 34*a*, and the rotation speed of the scroll compressor 30 are controlled by a controller (not shown).

The refrigeration cycle apparatus 300 may further include a four-way valve (not shown) for switching the flow of refrigerant to the forward or reverse direction. In this case, a heating operation is performed when the condenser 31 disposed downstream of the scroll compressor 30 is on the indoor unit side and the evaporator 33 is on the outdoor unit side, whereas a cooling operation is performed when the condenser 31 disposed downstream of the scroll compressor 30 is on the outdoor unit side and the evaporator 33 is on the indoor unit side. An injection operation is typically performed during heating operation, but may be performed during cooling operation.

Hereinafter, the circuit including the scroll compressor 30, the condenser 31, the expansion valve 32, and the evaporator 33 will be referred to as a main circuit, and a refrigerant circulating through the main circuit will be referred to as main refrigerant. A refrigerant flowing through the injection circuit 34 will be referred to as injection refrigerant.

A flow of refrigerant will now be described.

(Flow of Main Refrigerant)

In the main circuit, main refrigerant discharged from the scroll compressor 30 passes through the condenser 31, the expansion valve 32, and the evaporator 33 and returns to the scroll compressor 30. The refrigerant returning to the scroll compressor 30 flows through the suction pipe 101 into the hermetic container 100.

Low-pressure refrigerant flowing through the suction pipe 101 into the first space 72 in the hermetic container 100 passes through the two cavities 7*c* and 7*d* in the frame 7 and flows into the second space 73. As the orbiting spiral body 1*b* and the fixed spiral body 2*b* of the compression mechanism 8 relatively orbit, the low-pressure refrigerant flowing into the second space 73 is sucked into the suction chambers 70*a* and 70*b*. The main refrigerant sucked in the suction chambers 70*a* and 70*b* is increased in pressure from a low to high level by a geometrical change in the volume of the compression chambers 71*a* and 71*b* as the orbiting spiral body 1*b* and the fixed spiral body 2*b* operate relative to each other. The main refrigerant increased in pressure pushes the discharge valve 11 open and is discharged into the discharge muffler 12. Then, the main refrigerant discharged into the discharge muffler 12 is further discharged into the third space 74, and discharged as high-pressure refrigerant through the discharge pipe 102 to the outside of the scroll compressor 30.

(Flow of Injection Refrigerant)

Injection refrigerant is part of the main refrigerant discharged from the scroll compressor 30 and passed through the condenser 31. The injection refrigerant flows into the injection circuit 34, passes through the expansion valve 34*a*, and flows into the injection pipe 201 in the scroll compressor 30. The liquid or two-phase injection refrigerant in the injection pipe 201 flows into the injection port 202*a*. The refrigerant flowing in the injection port 202*a* either flows into the suction chamber 70*a* in the compression mechanism 8 as described above, or is blocked by the tooth tip of the orbiting spiral body 1*b*.

In the technique disclosed in Patent Literature 1, when injection is performed for the purpose of lowering the discharge temperature, the diameter of the injection port is substantially the same as that of the tip seal. As a result, as the orbiting scroll orbits, the injection port interferes with the tip seal of the orbiting scroll, and the tip seal is scraped off by the edge portion of the injection port. This may cause compressed refrigerant to leak through the damaged portion of the tip seal, and lead to degraded performance. The orbiting scroll and the fixed scroll may bite the damaged tip seal, and cause abnormal stoppage.

On the other hand, in Embodiment 1, the installation position of the injection port 202*a* is defined by the installation angle α. This prevents the injection port 202*a* from interfering with the tip seal 1*d*. Therefore, in Embodiment 1, it is possible to prevent the tip seal 1*d* from being damaged, ensure reliability of the compression mechanism 8, and obtain a high-performance, low-pressure shell scroll compressor.

With the tip seal 1*d* at the tooth tip of the orbiting spiral body 1*b* and the tip seal 2*d* at the tooth tip of the fixed spiral body 2*b*, tooth-tip leakage of refrigerant is effectively prevented. However, even with only the tip seal 1*d* at the tooth tip of the orbiting spiral body 1*b*, it is still possible to some extent to prevent tooth-tip leakage of refrigerant. In this case, the tip seal 1*d* and the injection port 202*a* may be positioned in the same manner as above.

Embodiment 2

In Embodiment 2, the injection port 202*a* is open to the suction chamber 70*b* at some of all rotation phases, and is open to the compression chamber 71*b* at other rotation phases. Embodiment 2 describes only its features and omits the description of other characteristics.

Figure 10A:
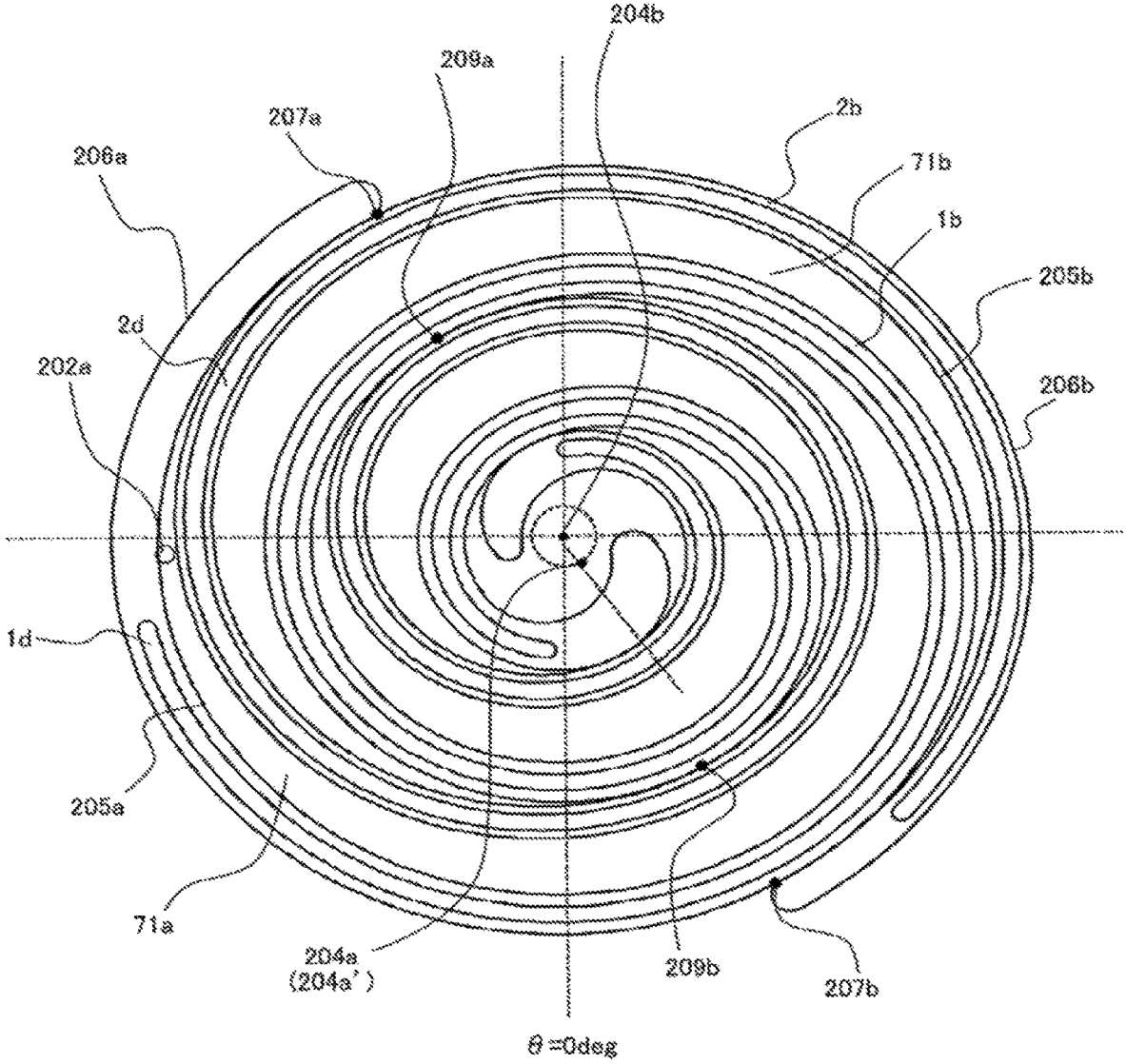
FIG. 10A is a compression process diagram illustrating an operation at θ=0 degrees in one rotation of the orbiting spiral body in a cross-section of a scroll compressor according to Embodiment 2 of the present invention, taken along line A-A in FIG. 1.
Figure 10B:
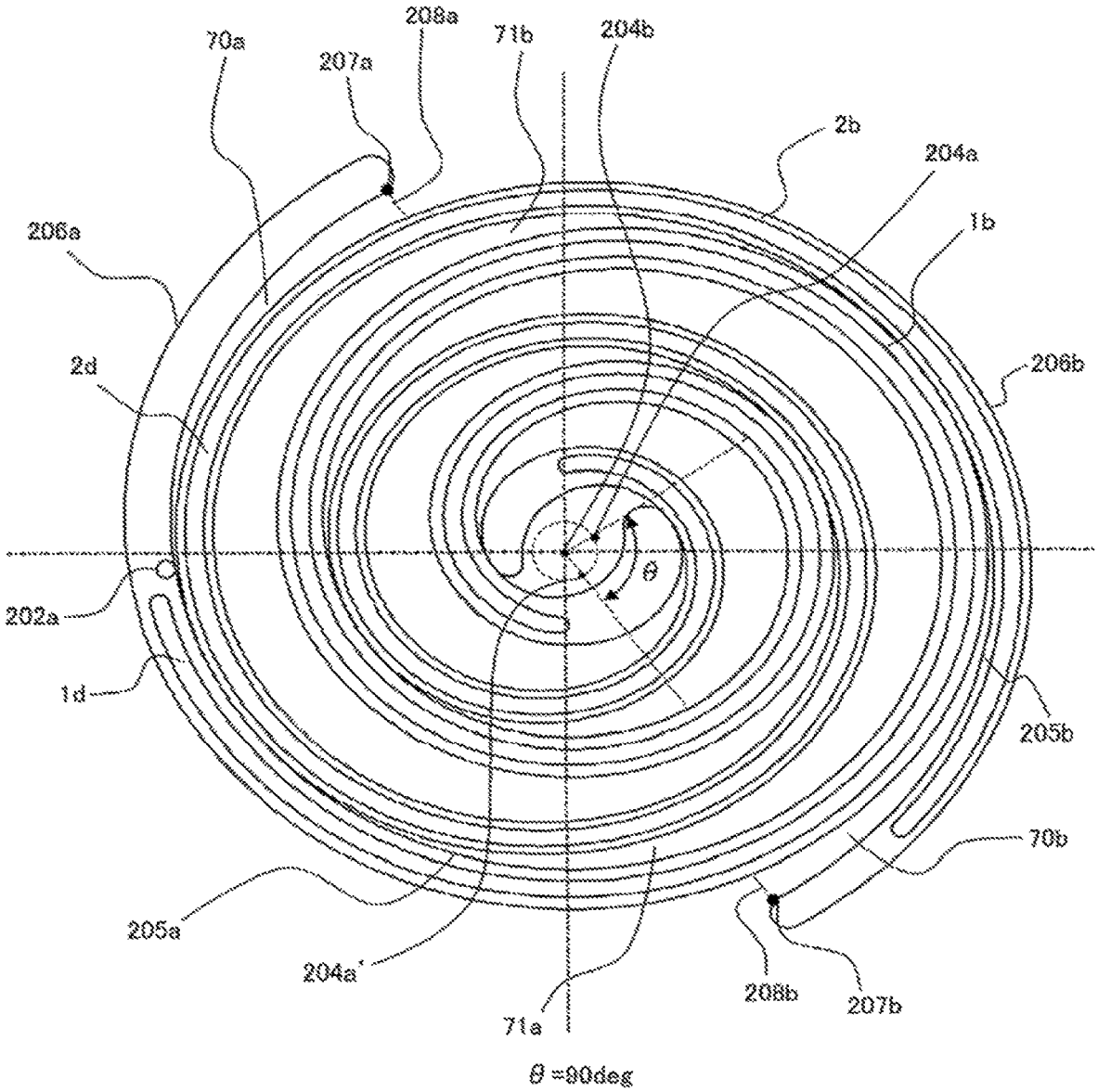
FIG. 10B is a compression process diagram illustrating an operation at θ=90 degrees in one rotation of the orbiting spiral body in the cross-section of the scroll compressor according to Embodiment 2 of the present invention, taken along line A-A in FIG. 1.
Figure 10C:
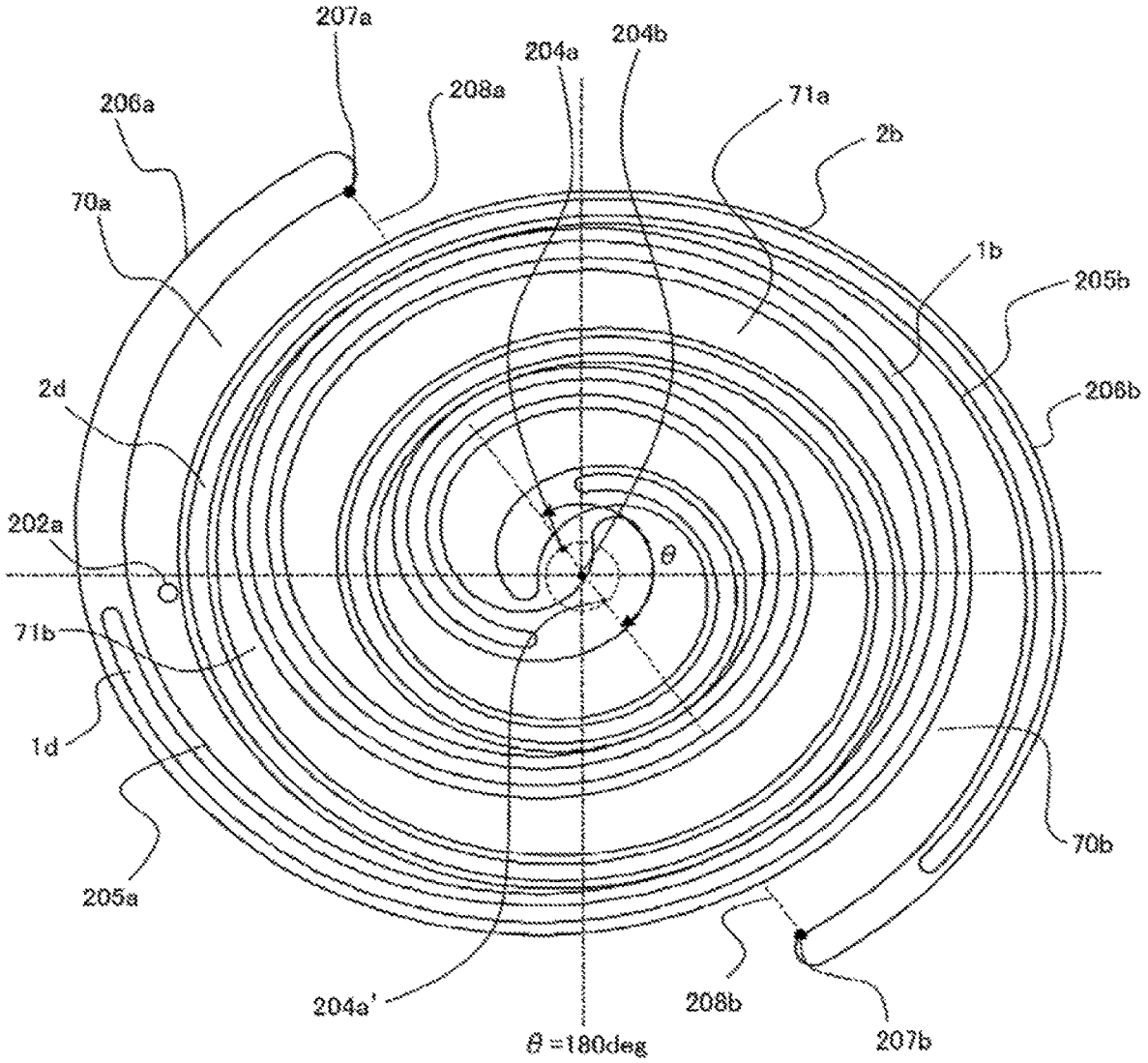
FIG. 10C is a compression process diagram illustrating an operation at θ=180 degrees in one rotation of the orbiting spiral body in the cross-section of the scroll compressor according to Embodiment 2 of the present invention, taken along line A-A in FIG. 1.
Figure 10D:
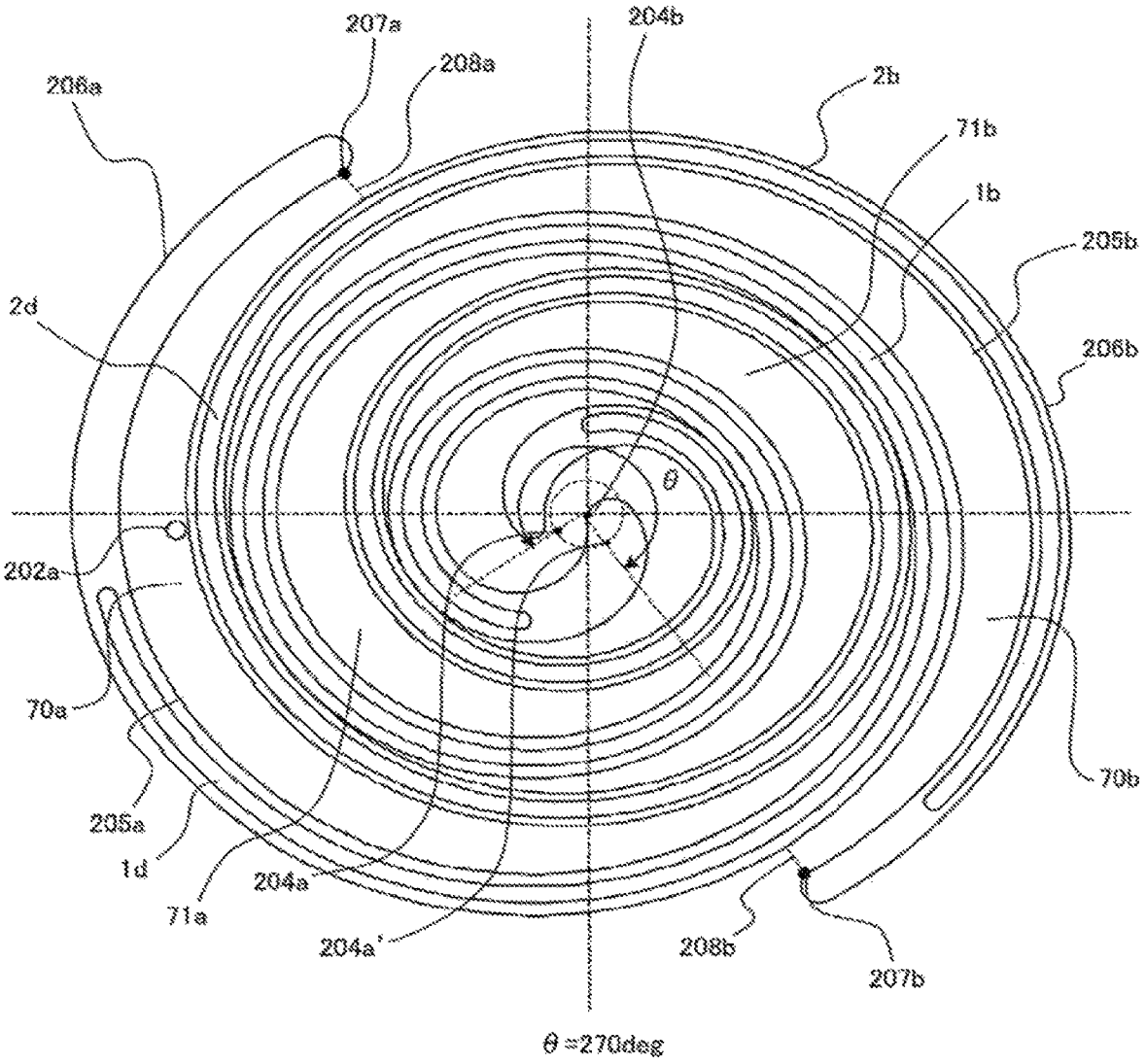
FIG. 10D is a compression process diagram illustrating an operation at θ=270 degrees in one rotation of the orbiting spiral body in the cross-section of the scroll compressor according to Embodiment 2 of the present invention, taken along line A-A in FIG. 1.

FIG. 10A is a compression process diagram illustrating an operation at θ=0 degrees in one rotation of the orbiting spiral body 1*b* in a cross-section of the scroll compressor 30 according to Embodiment 2 of the present invention, taken along line A-A in FIG. 1. FIG. 10B is a compression process diagram illustrating an operation at θ=90 degrees in one rotation of the orbiting spiral body 1*b* in the cross-section of the scroll compressor 30 according to Embodiment 2 of the present invention, taken along line A-A in FIG. 1. FIG. 10C is a compression process diagram illustrating an operation at θ=180 degrees in one rotation of the orbiting spiral body 1*b* in the cross-section of the scroll compressor 30 according to Embodiment 2 of the present invention, taken along line A-A in FIG. 1. FIG. 10D is a compression process diagram illustrating an operation at θ=270 degrees in one rotation of the orbiting spiral body 1*b* in the cross-section of the scroll compressor 30 according to Embodiment 2 of the present invention, taken along line A-A in FIG. 1. FIGS. 10A to 10D illustrate how the orbiting spiral body 1*b* orbits as the rotation phase θ changes in the following order: 0 degrees→90 degrees→180 degrees→270 degrees.

Figure 11:
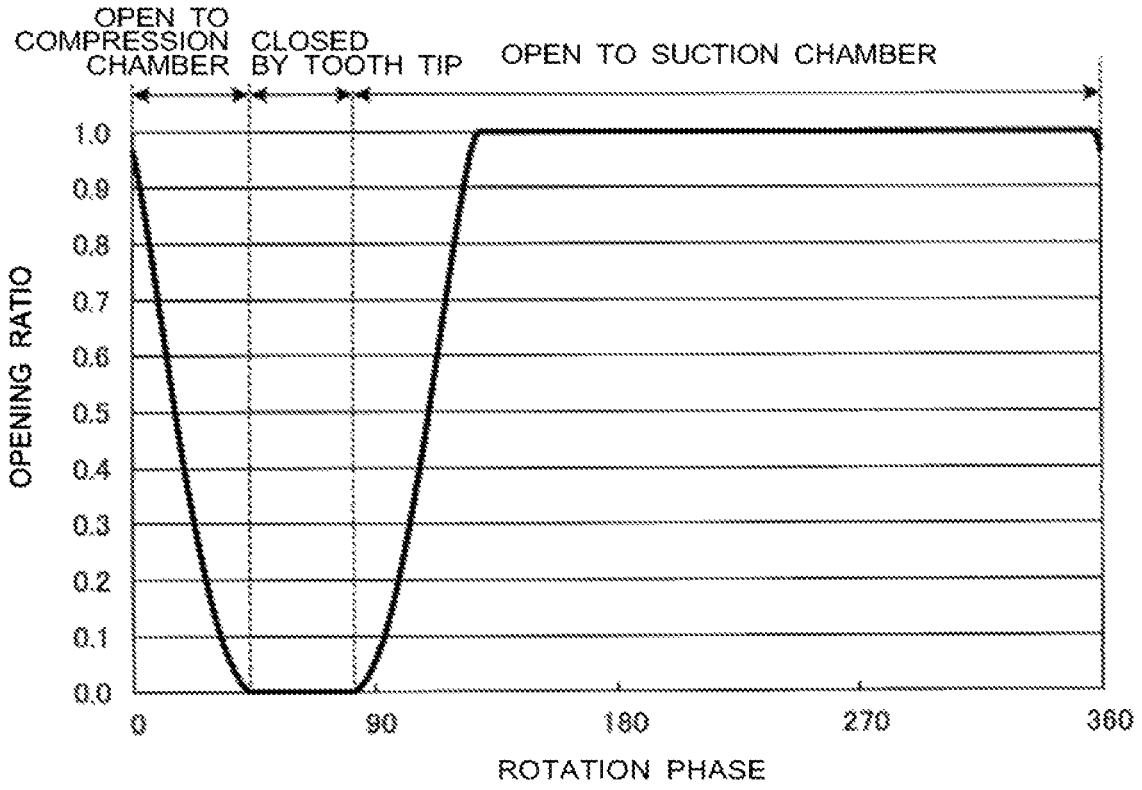
FIG. 11 is a diagram illustrating an injection port opening ratio in the scroll compressor according to Embodiment 2 of the present invention.

FIG. 11 is a diagram illustrating an injection port opening ratio in the scroll compressor 30 according to Embodiment 2 of the present invention. The opening ratio of the injection port 202*a* is the ratio of the area of the injection port 202*a* open to the suction chamber 70*a* or compression chamber 71*a*, to the total area of the injection port 202*a*.

At the rotation phase θ=0 degrees, the injection port 202*a* is slightly closed by the tooth tip of the orbiting spiral body 1*b* as illustrated in FIG. 10A. The outermost chamber at this time point is the compression chamber 71*a*. As the rotation phase θ advances, the opening ratio of the injection port 202*a* decreases and the injection port 202*a* is completely closed at the rotation phase θ=45 degrees. The injection port 202*a* begins to open to the suction chamber 70*a* at around the rotation phase θ=80 degrees. Then, the opening ratio gradually increases and the injection port 202*a* completely opens at around the rotation phase θ=130 degrees. The rotation phase θ further advances, and the injection port 202*a* begins to be closed again by the orbiting spiral body 1*b* at around the rotation phase θ=355 degrees. At the rotation phases θ=90 degrees, 180 degrees, and 270 degrees, the opening ratio changes as illustrated in FIGS. 10B, 10C, and 10D.

That is, the injection port 202*a* is partly open to the compression chamber 71*a* at the rotation phase θ=0 degrees. The injection port 202*a* is partly open to the suction chamber 70*a* at the rotation phase θ=90 degrees. The injection port 202*a* is completely open to the suction chamber 70*a* at the rotation phases θ=180 degrees and 270 degrees. The same operation as above is repeated at the rotation phase θ=360 degrees and thereafter.

In Embodiment 1, the injection port 202*a* opens only to the suction chamber 70*a*. On the other hand, in Embodiment 2, where the injection port 202*a* opens also to the compression chamber 71*b*, the injection port 202*a* is positioned away from the suction port 208*a* toward the base circle center 204*a* of the orbiting spiral body 1*b*. Therefore, the winding end of the tip seal 1*d* in Embodiment 2 is shorter than the winding end of the tip seal 1*d* in Embodiment 1.

With the configuration described above, the following effects are achieved as well as those achieved in Embodiment 1. Injection refrigerant becomes less likely to flow out into the oil sump 100*a* and it is possible to reduce dilution of refrigerating machine oil stored in the oil sump 100*a*. That is, it is possible to reduce a decrease in the viscosity of refrigerating machine oil, and reduce degradation in the reliability of a lubricating portion.

In Embodiments 1 and 2, the injection port 202*a* is provided within the range of the installation angle α, which is outside the winding-end position of the tip seal 1*d*, to prevent the injection port 202*a* from interfering with the tip seal 1*d*. In Embodiment 1, the injection port 202*a* is open to the suction chamber 70*a* at some rotation phases. In Embodiment 2, the injection port 202*a* is open to the suction chamber 70*a* at some rotation phases, and is open also to the compression chamber 71*a* at other rotation phases.

To provide an injection port at a position where it opens only to a compression chamber, a tip seal may be divided to create a region where the tip seal is absent, at a position overlapping the injection port, to prevent interference. However, this configuration leads to increased leakage, because the compression chamber is not sufficiently sealed with the tip seal. Therefore, it is difficult to apply the present invention to the case where the injection port opens only to the compression chamber.

Embodiment 3

In Embodiment 3, the compression mechanism has a so-called asymmetrical spiral structure where two suction ports are at the same phase. Embodiment 3 describes only its features and omits the description of other characteristics.

Figure 12A:
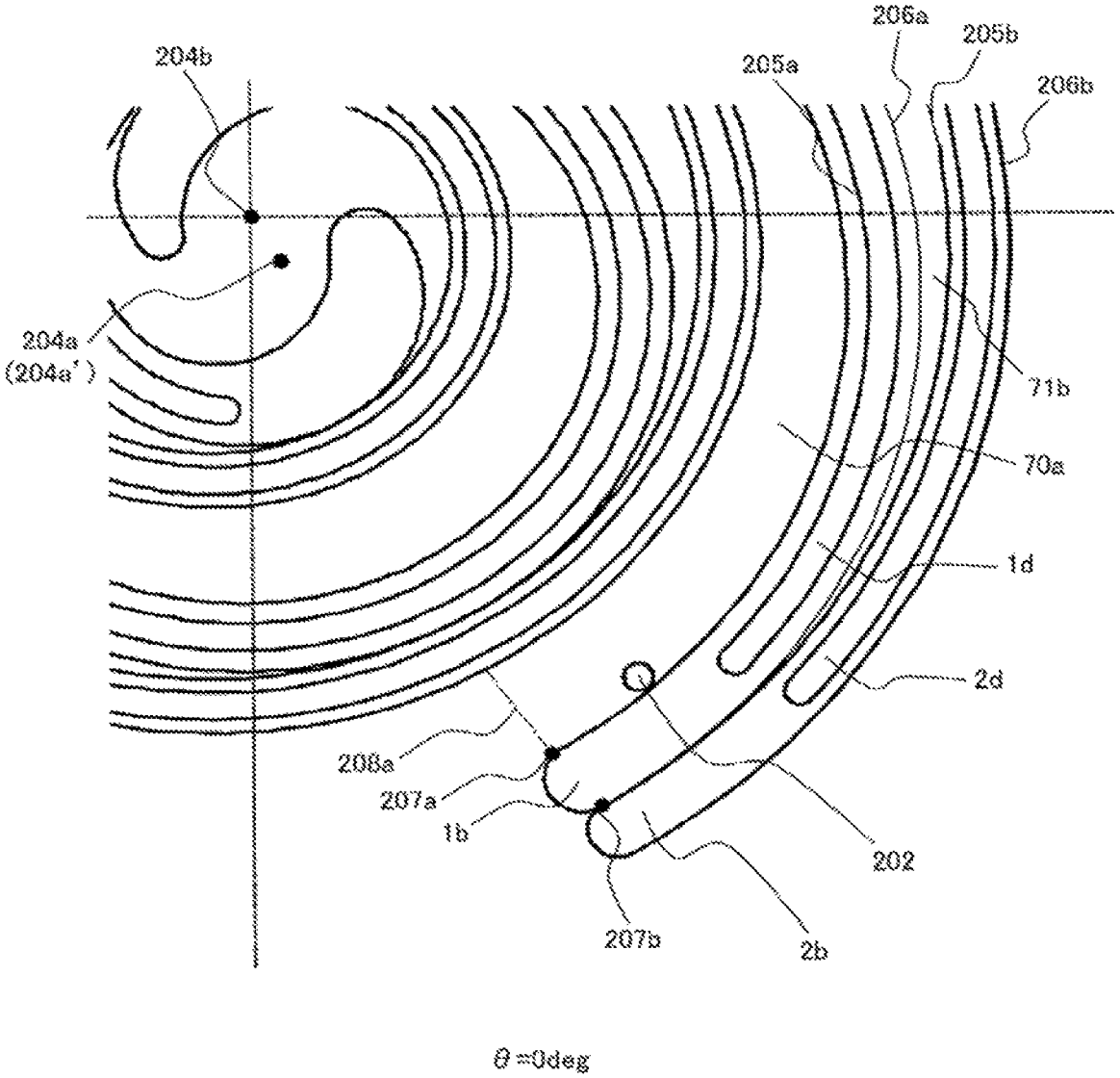
FIG. 12A is a compression process diagram illustrating an operation at θ=0 degrees in one rotation of the orbiting spiral body in the vicinity of an injection port in a cross-section of a scroll compressor according to Embodiment 3 of the present invention, taken along line A-A in FIG. 1.
Figure 12B:
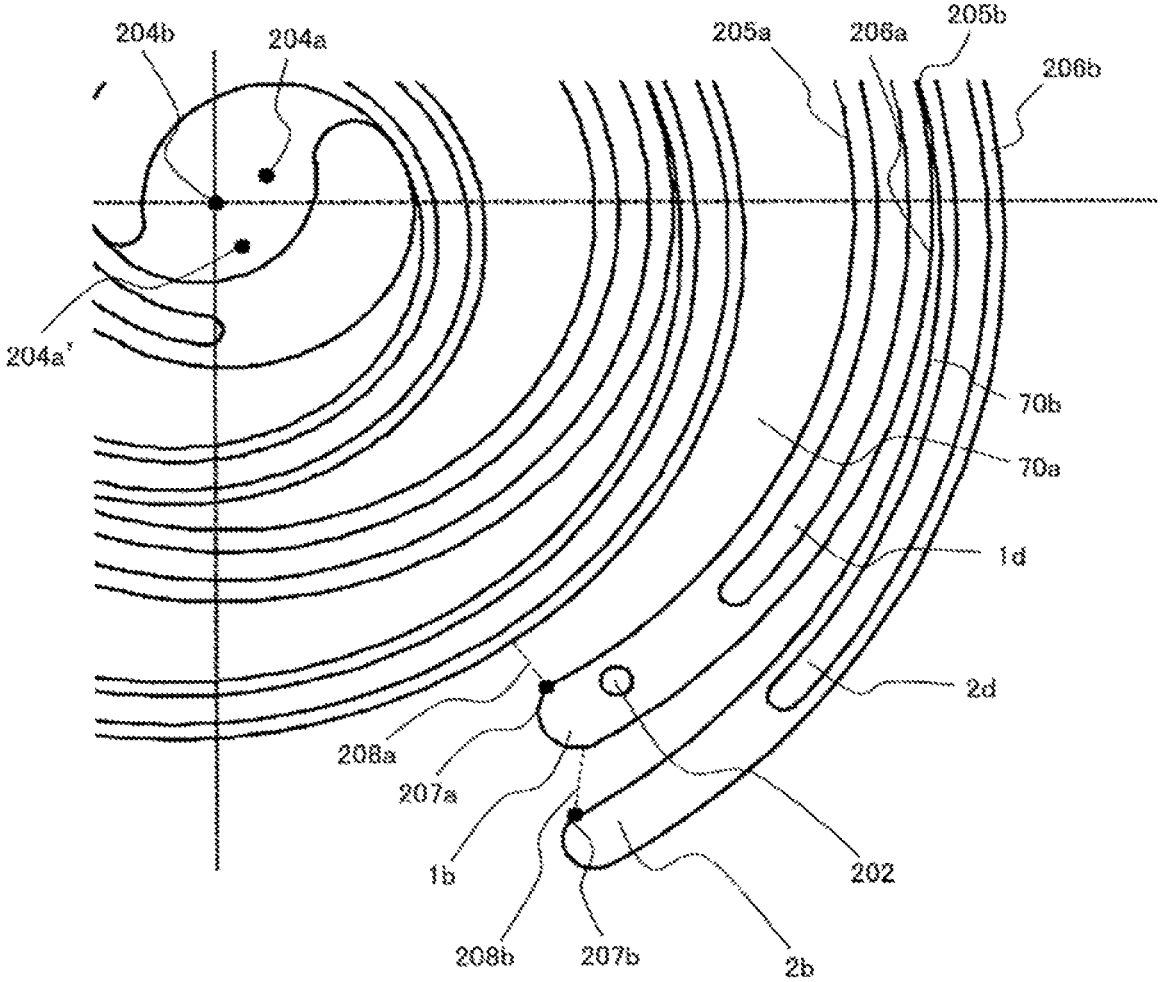
FIG. 12B is a compression process diagram illustrating an operation at θ=90 degrees in one rotation of the orbiting spiral body in the vicinity of the injection port in the cross-section of the scroll compressor according to Embodiment 3 of the present invention, taken along line A-A in FIG. 1.
Figure 12C:
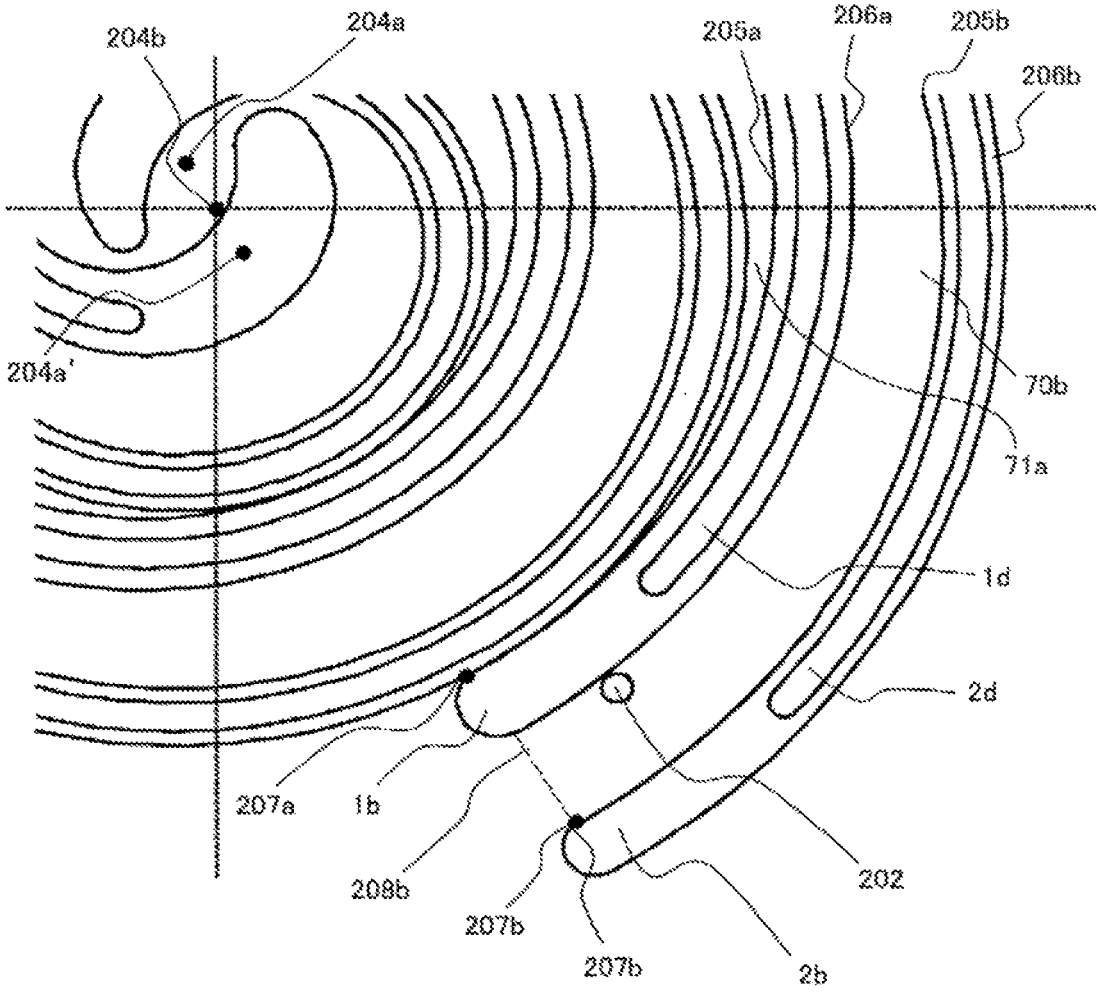
FIG. 12C is a compression process diagram illustrating an operation at θ=180 degrees in one rotation of the orbiting spiral body in the vicinity of the injection port in the cross-section of the scroll compressor according to Embodiment 3 of the present invention, taken along line A-A in FIG. 1.
Figure 12D:
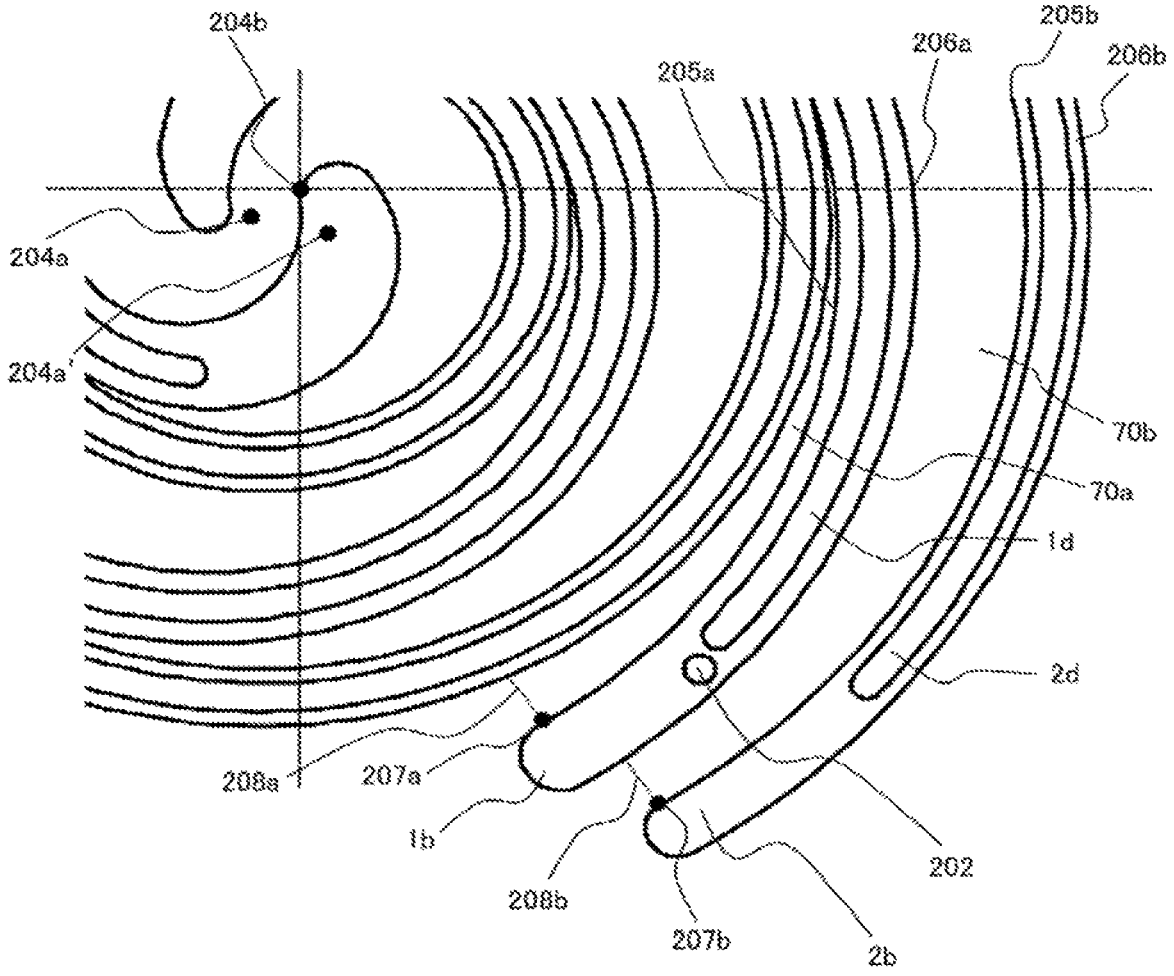
FIG. 12D is a compression process diagram illustrating an operation at θ=270 degrees in one rotation of the orbiting spiral body in the vicinity of the injection port in the cross-section of the scroll compressor according to Embodiment 3 of the present invention, taken along line A-A in FIG. 1.

FIG. 12A is a compression process diagram illustrating an operation at θ=0 degrees in one rotation of the orbiting spiral body 1*b* in the vicinity of an injection port 202 in a cross-section of the scroll compressor 30 according to Embodiment 3 of the present invention, taken along line A-A in FIG. 1. FIG. 12B is a compression process diagram illustrating an operation at θ=90 degrees in one rotation of the orbiting spiral body 1*b* in the vicinity of the injection port 202 in the cross-section of the scroll compressor 30 according to Embodiment 3 of the present invention, taken along line A-A in FIG. 1. FIG. 12C is a compression process diagram illustrating an operation at θ=180 degrees in one rotation of the orbiting spiral body 1*b* in the vicinity of the injection port 202 in the cross-section of the scroll compressor 30 according to Embodiment 3 of the present invention, taken along line A-A in FIG. 1. FIG. 12D is a compression process diagram illustrating an operation at θ=270 degrees in one rotation of the orbiting spiral body 1*b* in the vicinity of the injection port 202 in the cross-section of the scroll compressor 30 according to Embodiment 3 of the present invention, taken along line A-A in FIG. 1. The injection port 202 corresponds to the first injection port of the present invention.

In a symmetrical spiral structure, there are two suction ports at the respective winding-end portions of the orbiting spiral body 1*b* and the fixed spiral body 2*b*. The suction chambers 70*a* and 70*b* and the compression chambers 71*a* and 71*b* both have a symmetrical structure, and two injection ports 202*a* and 202*b* are required for injection to both chambers that are symmetrical. However, Embodiment 3 adopts an asymmetrical spiral structure. This means that there is only one suction port at the winding-end portion of the orbiting spiral body 1*b* and the fixed spiral body 2*b*, and only one injection port 202 is required. To reduce leakage of compressed refrigerant gas from the compression chambers 71*a* and 71*b* to the adjacent suction chambers 70*b* and 70*a*, respectively, across the injection port 202, the port diameter of the injection port 202 needs to be smaller than the tooth thickness of the orbiting spiral body 1*b*.

In the symmetrical spiral structure with the injection ports 202*a* and 202*b*, the port diameter of the injection port 202*b* for injection to the suction chamber 70*b* and the compression chamber 71*b* can be increased only up to the width of one side obtained by excluding the tip seal width from the tooth thickness. In the asymmetrical spiral structure, on the other hand, one injection port 202 allows injection into both the suction chambers 70*a* and 70*b* and the port diameter can be increased up to the tooth thickness. This increases the amount of injection and makes it possible to achieve a greater effect.

Embodiment 4

Embodiment 4 includes the injection port 202*b* that opens to the suction chamber 70*b*, in addition to the injection port 202*a* of Embodiment 1. Embodiment 4 describes only its features and omits the description of other characteristics.

Figure 13A:
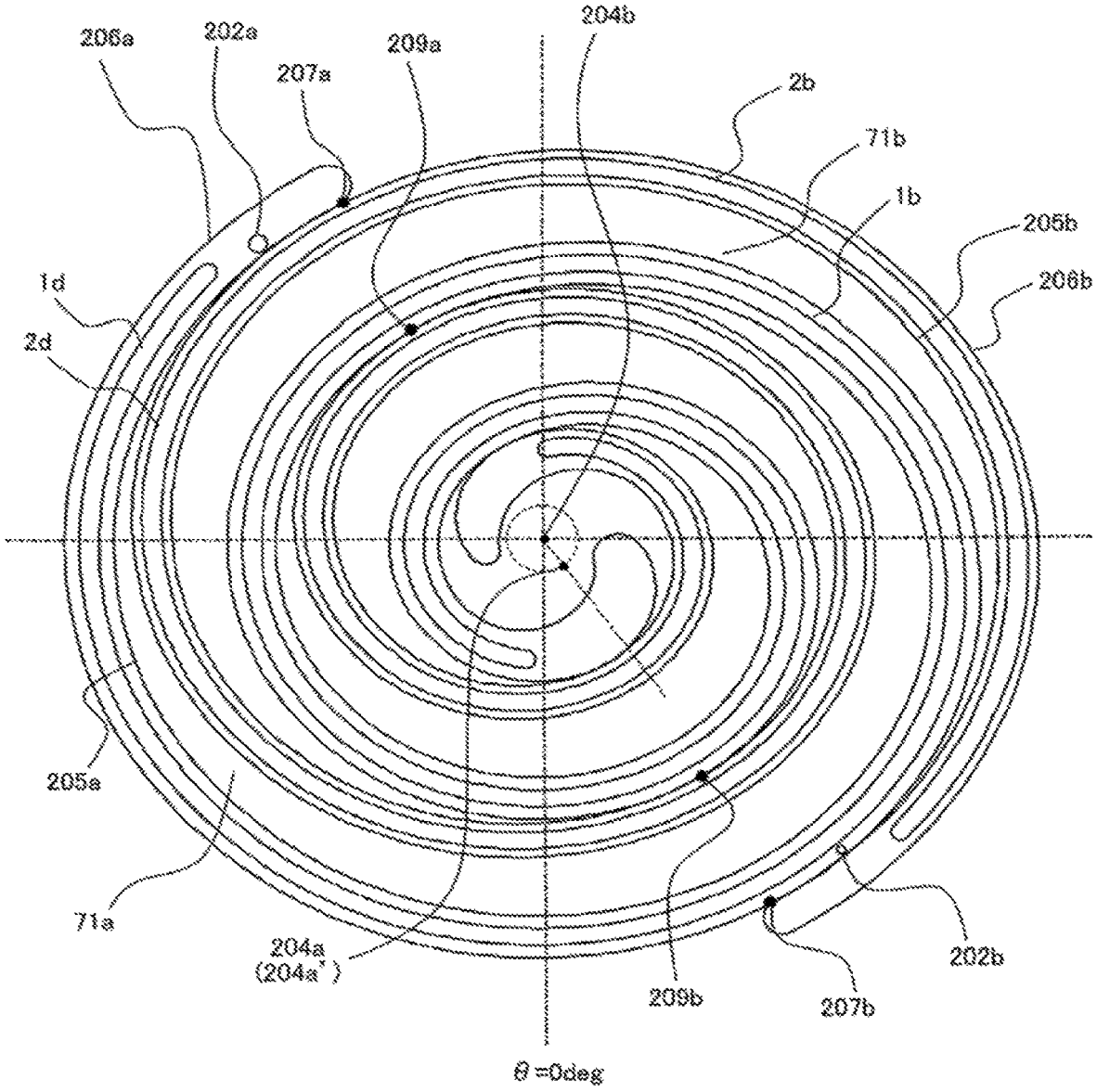
FIG. 13A is a compression process diagram illustrating an operation at θ=0 degrees in one rotation of the orbiting spiral body in a cross-section of a scroll compressor according to Embodiment 4 of the present invention, taken along line A-A in FIG. 1.
Figure 13B:
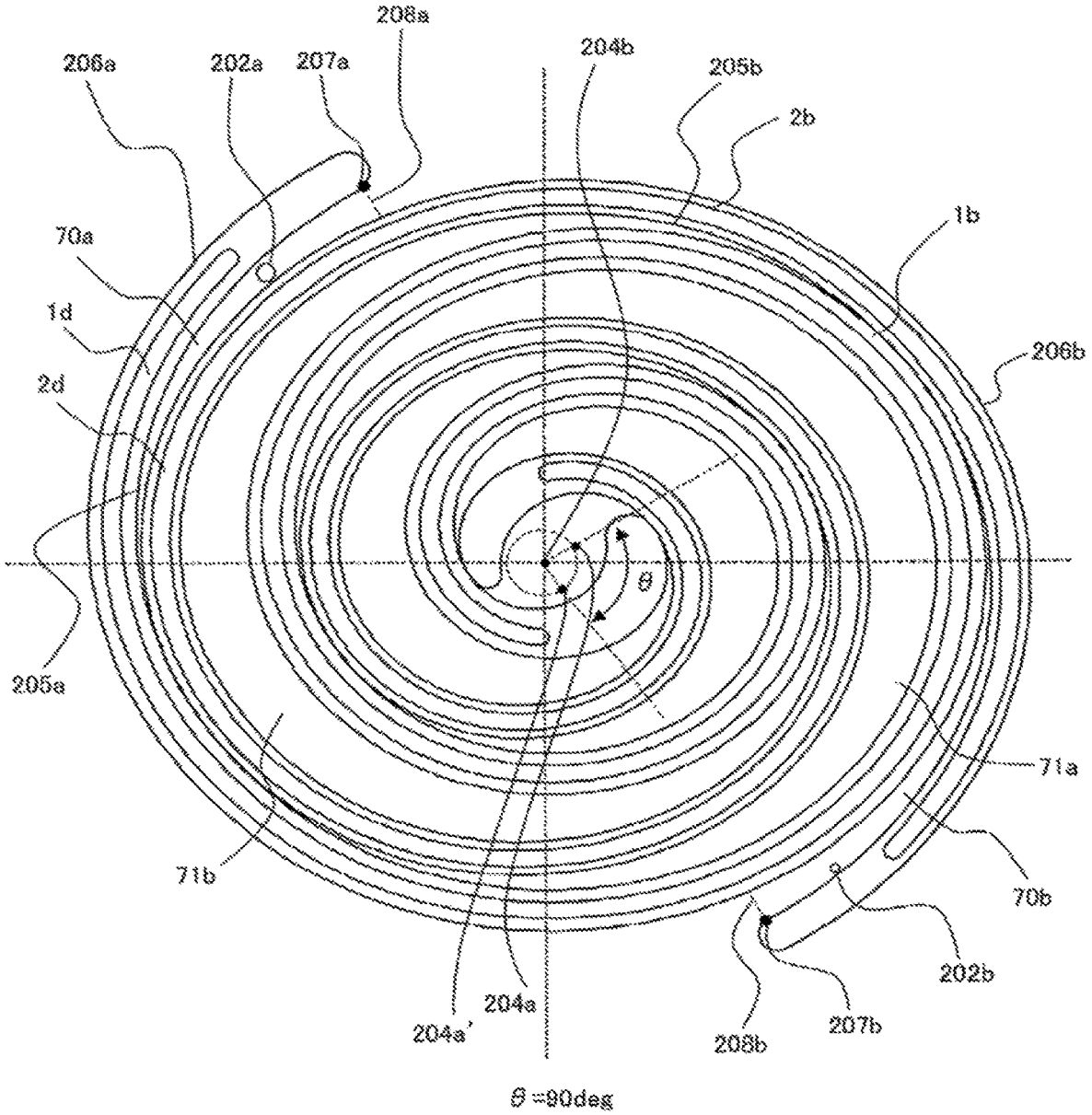
FIG. 13B is a compression process diagram illustrating an operation at θ=90 degrees in one rotation of the orbiting spiral body in the cross-section of the scroll compressor according to Embodiment 4 of the present invention, taken along line A-A in FIG. 1.
Figure 13C:
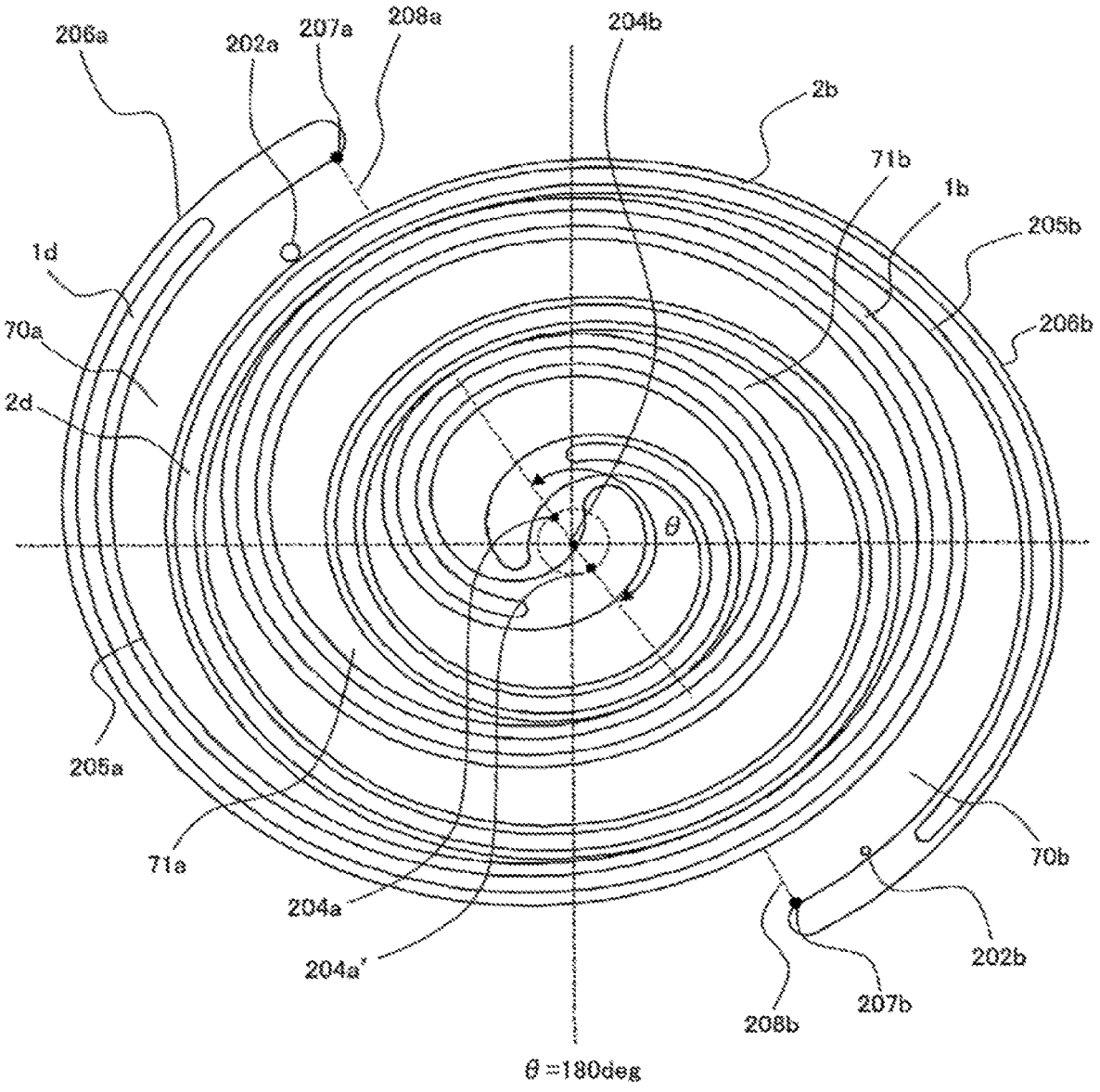
FIG. 13C is a compression process diagram illustrating an operation at θ=180 degrees in one rotation of the orbiting spiral body in the cross-section of the scroll compressor according to Embodiment 4 of the present invention, taken along line A-A in FIG. 1.
Figure 13D:
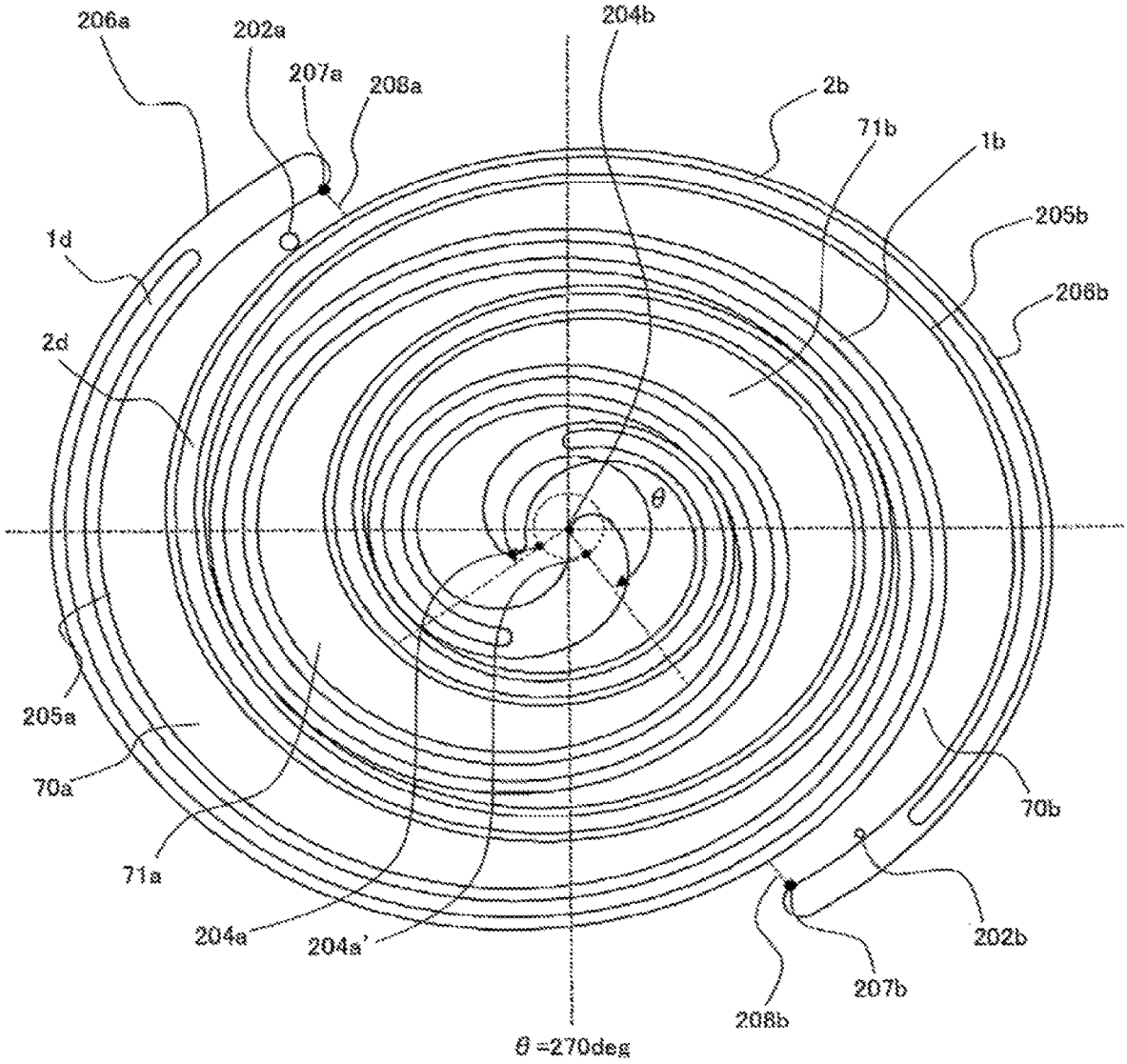
FIG. 13D is a compression process diagram illustrating an operation at θ=270 degrees in one rotation of the orbiting spiral body in the cross-section of the scroll compressor according to Embodiment 4 of the present invention, taken along line A-A in FIG. 1.

FIG. 13A is a compression process diagram illustrating an operation at θ=0 degrees in one rotation of the orbiting spiral body 1*b* in a cross-section of the scroll compressor 30 according to Embodiment 4 of the present invention, taken along line A-A in FIG. 1. FIG. 13B is a compression process diagram illustrating an operation at θ=90 degrees in one rotation of the orbiting spiral body 1*b* in the cross-section of the scroll compressor 30 according to Embodiment 4 of the present invention, taken along line A-A in FIG. 1. FIG. 13C is a compression process diagram illustrating an operation at θ=180 degrees in one rotation of the orbiting spiral body 1*b* in the cross-section of the scroll compressor 30 according to Embodiment 4 of the present invention, taken along line A-A in FIG. 1. FIG. 13D is a compression process diagram illustrating an operation at θ=270 degrees in one rotation of the orbiting spiral body 1*b* in the cross-section of the scroll compressor 30 according to Embodiment 4 of the present invention, taken along line A-A in FIG. 1. FIGS. 13A to 13D illustrate how the orbiting spiral body 1*b* orbits as the rotation phase θ changes in the following order: 0 degrees 90 degrees 180 degrees 270 degrees.

Embodiment 1 includes only the injection port 202*a* that is positioned to open to the suction chamber 70*a*. On the other hand, Embodiment 4 includes not only the injection port 202*a* opening to the suction chamber 70*a*, but also includes the injection port 202*b* that opens to the suction chamber 70*b* in the phase opposite the injection port 202*a*. The injection port 202*b* corresponds to a second injection port.

The injection port 202*b* is open to the suction chamber 70*b* of a plurality of chambers at some rotation phases. The injection port 202*b* is disposed adjacent to the inward surface 205*b* of the fixed spiral body 2*b* of the fixed scroll 2. As illustrated in FIG. 13A, the bore diameter of the injection port 202*b* in the spiral thickness direction of the orbiting spiral body 1*b* of the orbiting scroll 1 is smaller than the width of one side of the tooth tip of the orbiting spiral body 1*b* of the orbiting scroll 1, excluding the tip seal 1*d*, when the tooth tip of the orbiting spiral body 1*b* of the orbiting scroll 1 closes the injection port 202*b*. This prevents the injection port 202*b* from interfering with the tip seal 1*d* at the tooth tip of the orbiting spiral body 1*b* of the orbiting scroll 1.

Note that the phrase "when the tooth tip of the orbiting spiral body 1*b* of the orbiting scroll 1 closes the injection port 202*b*" refers to the time when the outward surface 206*a* of the orbiting spiral body 1*b* of the orbiting scroll 1 comes into contact with the inward surface 205*b* of the fixed spiral body 2*b* of the fixed scroll 2 at the installation position of the injection port 202*b*.

Note also that "the width of one side of the tooth tip of the orbiting spiral body 1*b* of the orbiting scroll 1, excluding the tip seal 1*d*" refers to the width of one of both sides of the tip seal 1*d* in the center of the tooth tip of the orbiting spiral body 1*b* of the orbiting scroll 1.

With this configuration, the following effects are achieved as well as those achieved in Embodiment 1. That is, by injection into not only the suction chamber 70*a* but also into the suction chamber 70*b*, the amount of injection refrigerant is increased and the discharge temperature is more effectively reduced.

Embodiment 5

Embodiment 5 relates to the port shape of the injection port 202*b* provided in Embodiment 4. Embodiment 5 describes only its features and omits the description of other characteristics.

Figure 14A:
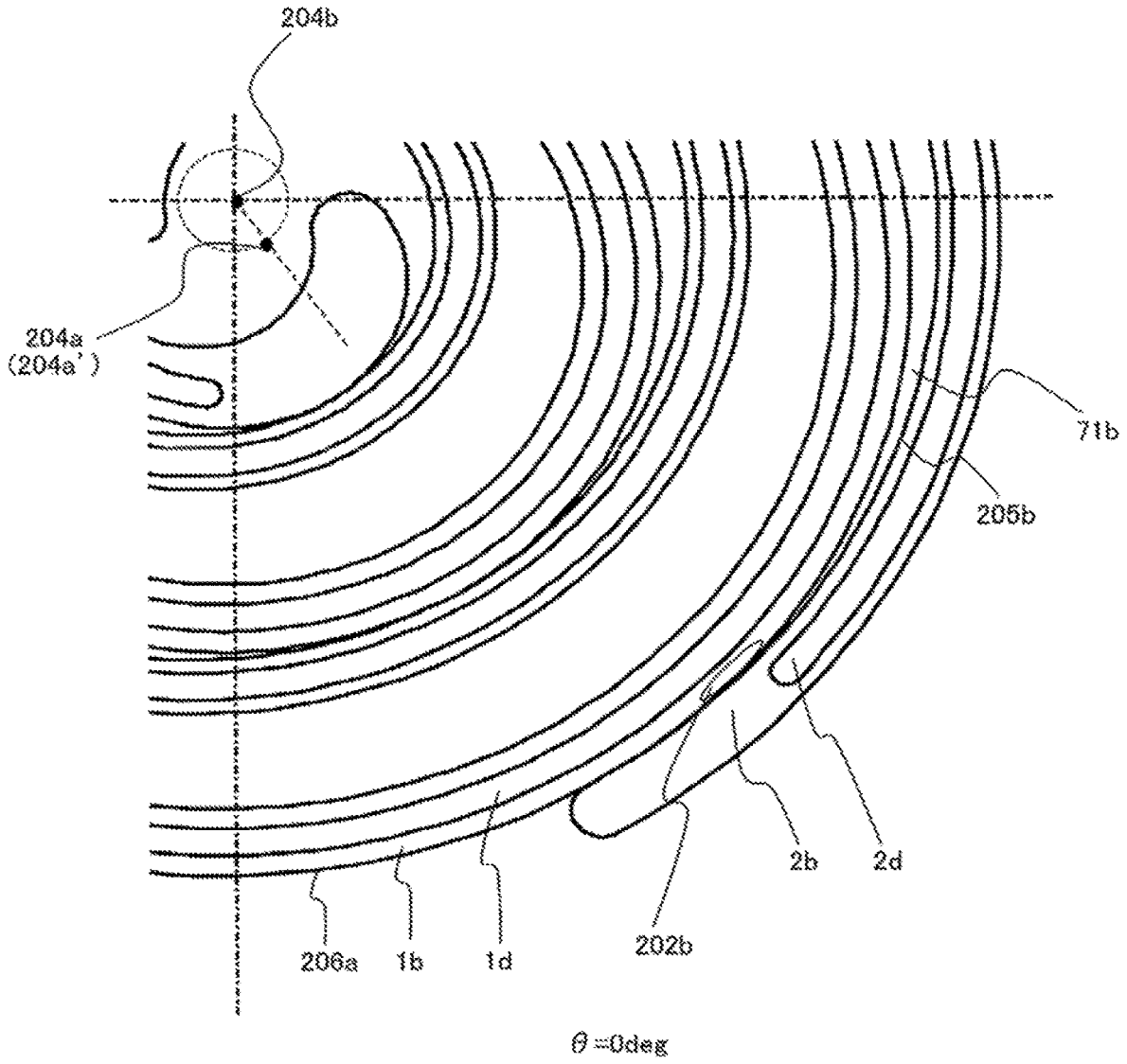
FIG. 14A is a compression process diagram illustrating an operation at θ=0 degrees in one rotation of the orbiting spiral body in the vicinity of an injection port in a cross-section of a scroll compressor according to Embodiment 5 of the present invention, taken along line A-A in FIG. 1.
Figure 14B:
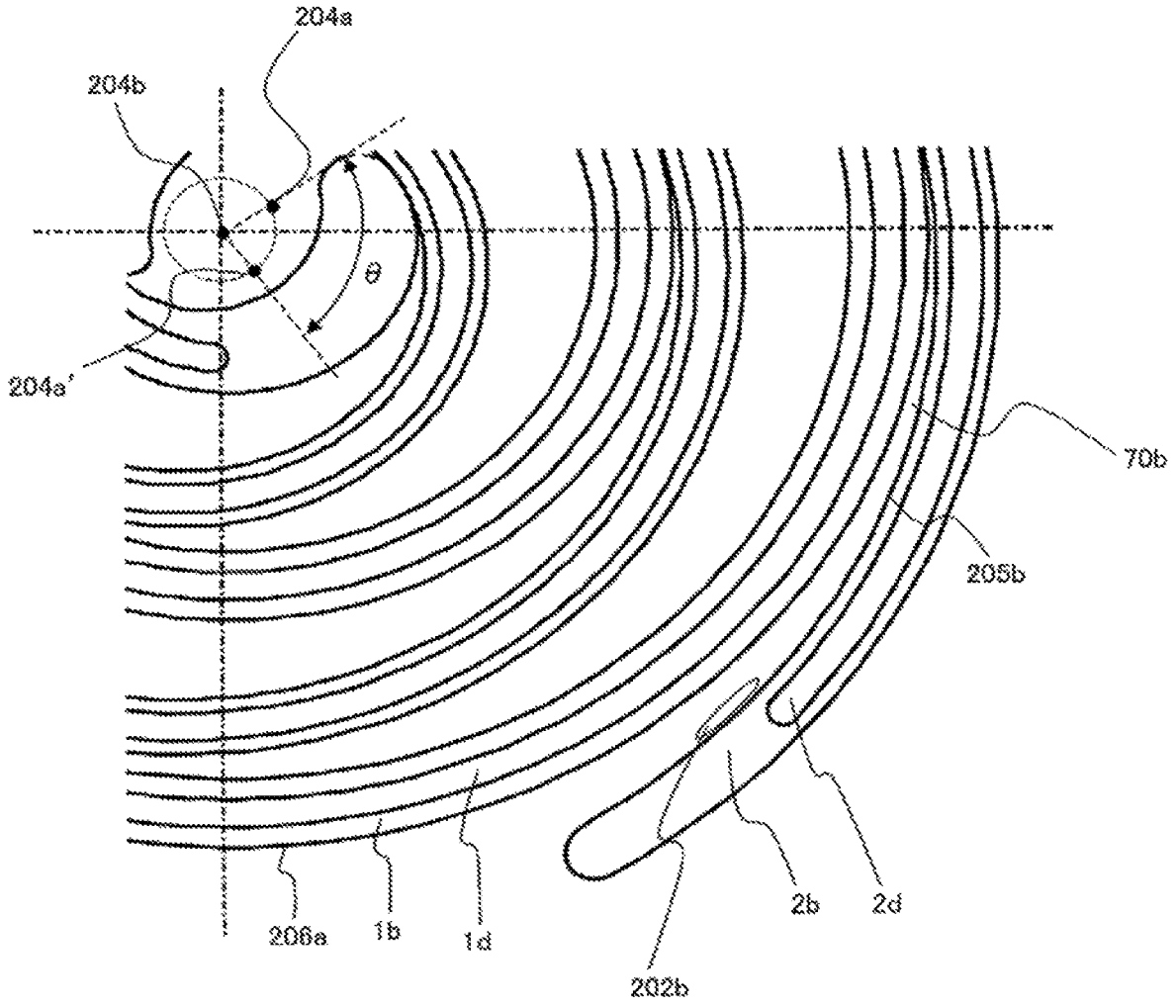
FIG. 14B is a compression process diagram illustrating an operation at θ=90 degrees in one rotation of the orbiting spiral body in the vicinity of the injection port in the cross-section of the scroll compressor according to Embodiment 5 of the present invention, taken along line A-A in FIG. 1.
Figure 14C:
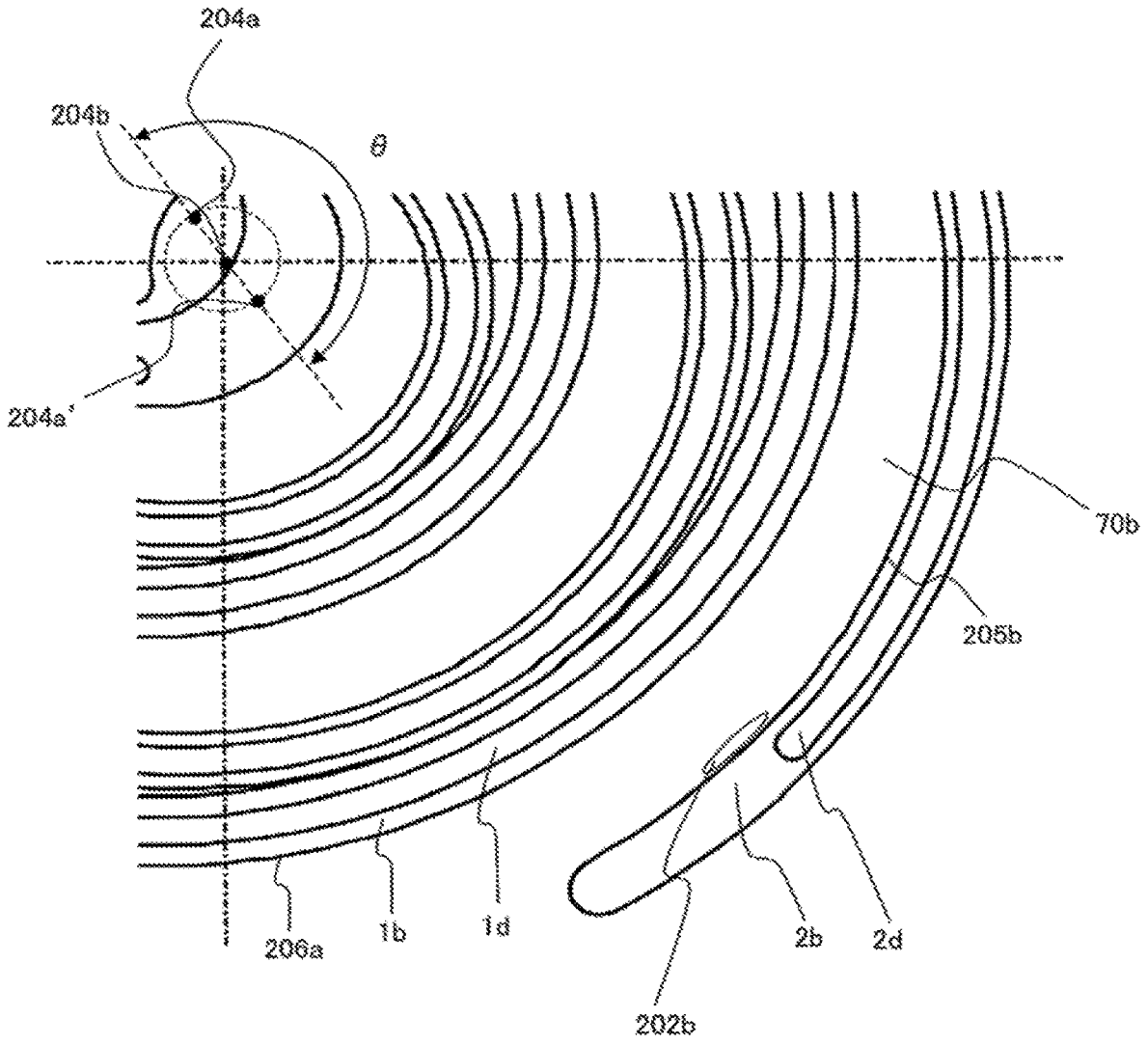
FIG. 14C is a compression process diagram illustrating an operation at θ=180 degrees in one rotation of the orbiting spiral body in the vicinity of the injection port in the cross-section of the scroll compressor according to Embodiment 5 of the present invention, taken along line A-A in FIG. 1.
Figure 14D:
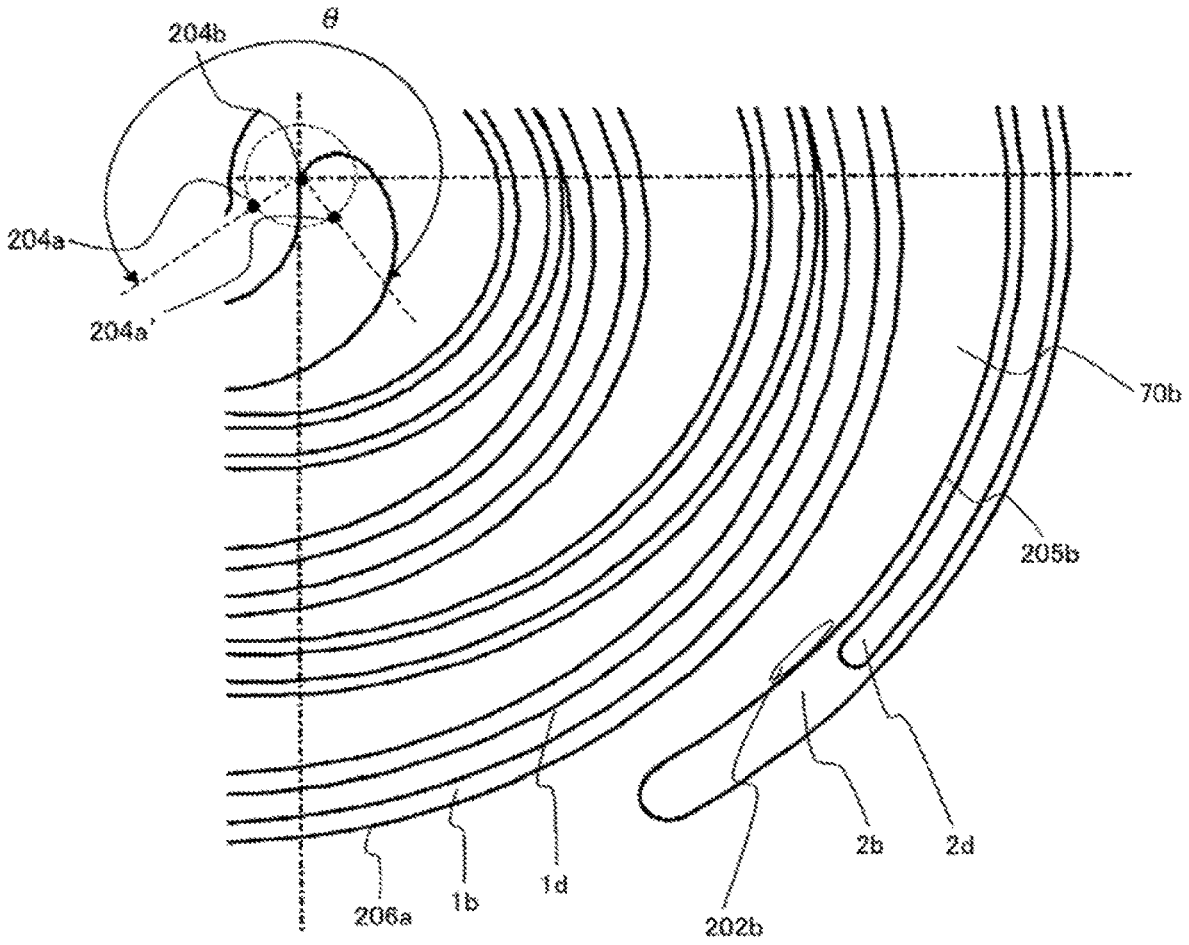
FIG. 14D is a compression process diagram illustrating an operation at θ=270 degrees in one rotation of the orbiting spiral body in the vicinity of the injection port in the cross-section of the scroll compressor according to Embodiment 5 of the present invention, taken along line A-A in FIG. 1.

FIG. 14A is a compression process diagram illustrating an operation at θ=0 degrees in one rotation of the orbiting spiral body 1*b* in the vicinity of the injection port 202*b* in a cross-section of the scroll compressor 30 according to Embodiment 5 of the present invention, taken along line A-A in FIG. 1. FIG. 14B is a compression process diagram illustrating an operation at θ=90 degrees in one rotation of the orbiting spiral body 1*b* in the vicinity of the injection port 202*b* in the cross-section of the scroll compressor 30 according to Embodiment 5 of the present invention, taken along line A-A in FIG. 1. FIG. 14C is a compression process diagram illustrating an operation at θ=180 degrees in one rotation of the orbiting spiral body 1*b* in the vicinity of the injection port 202*b* in the cross-section of the scroll compressor 30 according to Embodiment 5 of the present invention, taken along line A-A in FIG. 1. FIG. 14D is a compression process diagram illustrating an operation at θ=270 degrees in one rotation of the orbiting spiral body 1*b* in the vicinity of the injection port 202*b* in the cross-section of the scroll compressor 30 according to Embodiment 5 of the present invention, taken along line A-A in FIG. 1. FIGS. 14A to 14D illustrate how the orbiting spiral body 1*b* orbits as the rotation phase θ changes in the following order: 0 degrees→90 degrees→180 degrees→270 degrees.

In Embodiment 5, the opening of the injection port 202*b* has a long flat shape along the inward surface 205*b* of the fixed spiral body 2*b* of the fixed scroll 2.

With this configuration, the following effects are achieved in addition to those achieved in Embodiment 3. That is, the injection port 202*b* having a large opening area can be provided without causing the injection port 202*b* to interfere with the tip seal 1*d* during orbiting movement. It is thus possible to secure a flow passage area of injection refrigerant and obtain a necessary and sufficient amount of injection.

Embodiment 6

Embodiment 6 relates to the port shape of the injection port 202*b* provided in Embodiment 3. Embodiment 6 describes only its features and omits the description of other characteristics.

Figure 15A:
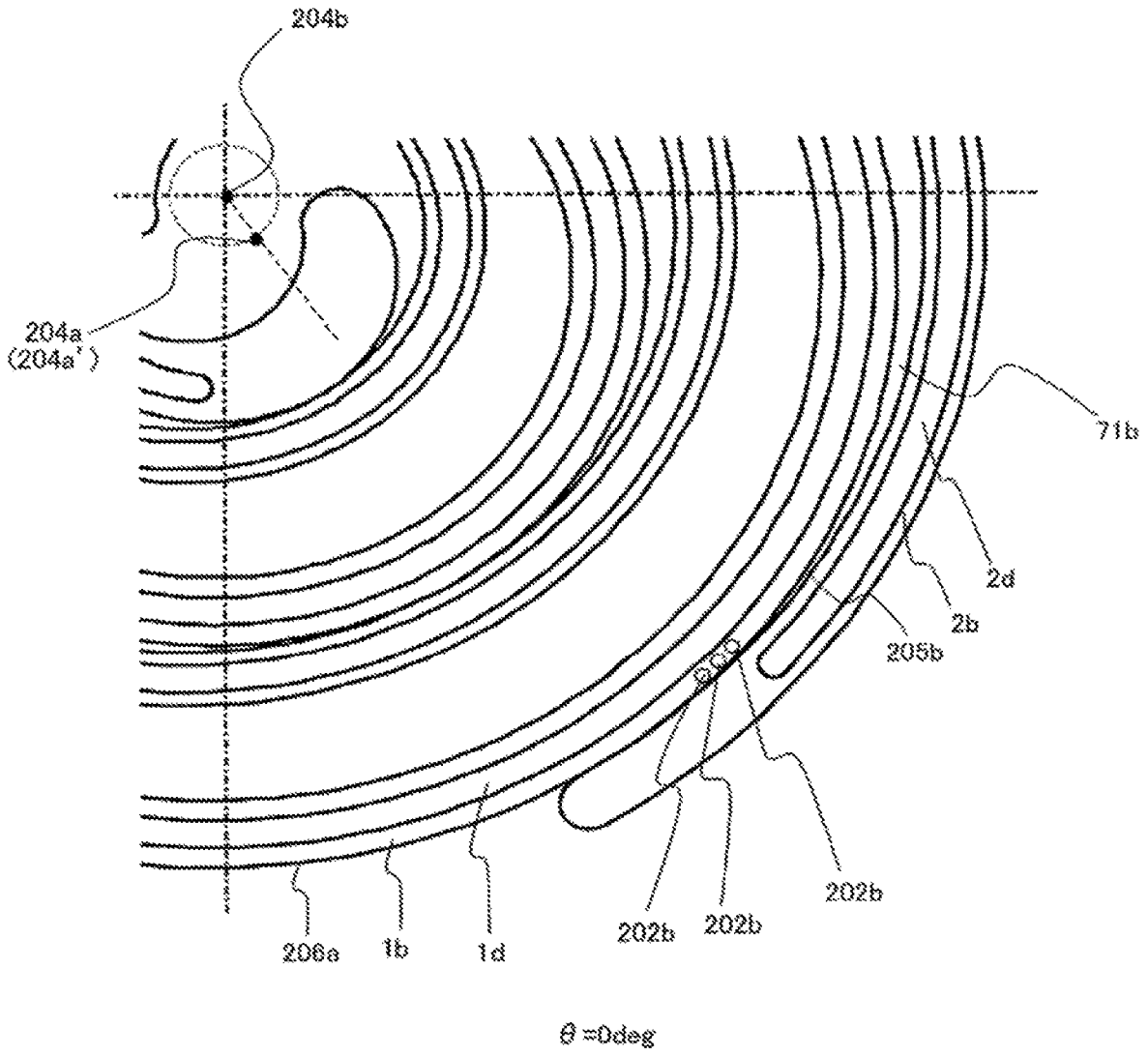
FIG. 15A is a compression process diagram illustrating an operation at θ=0 degrees in one rotation of the orbiting spiral body in the vicinity of injection ports in a cross-section of a scroll compressor according to Embodiment 6 of the present invention, taken along line A-A in FIG. 1.
Figure 15B:
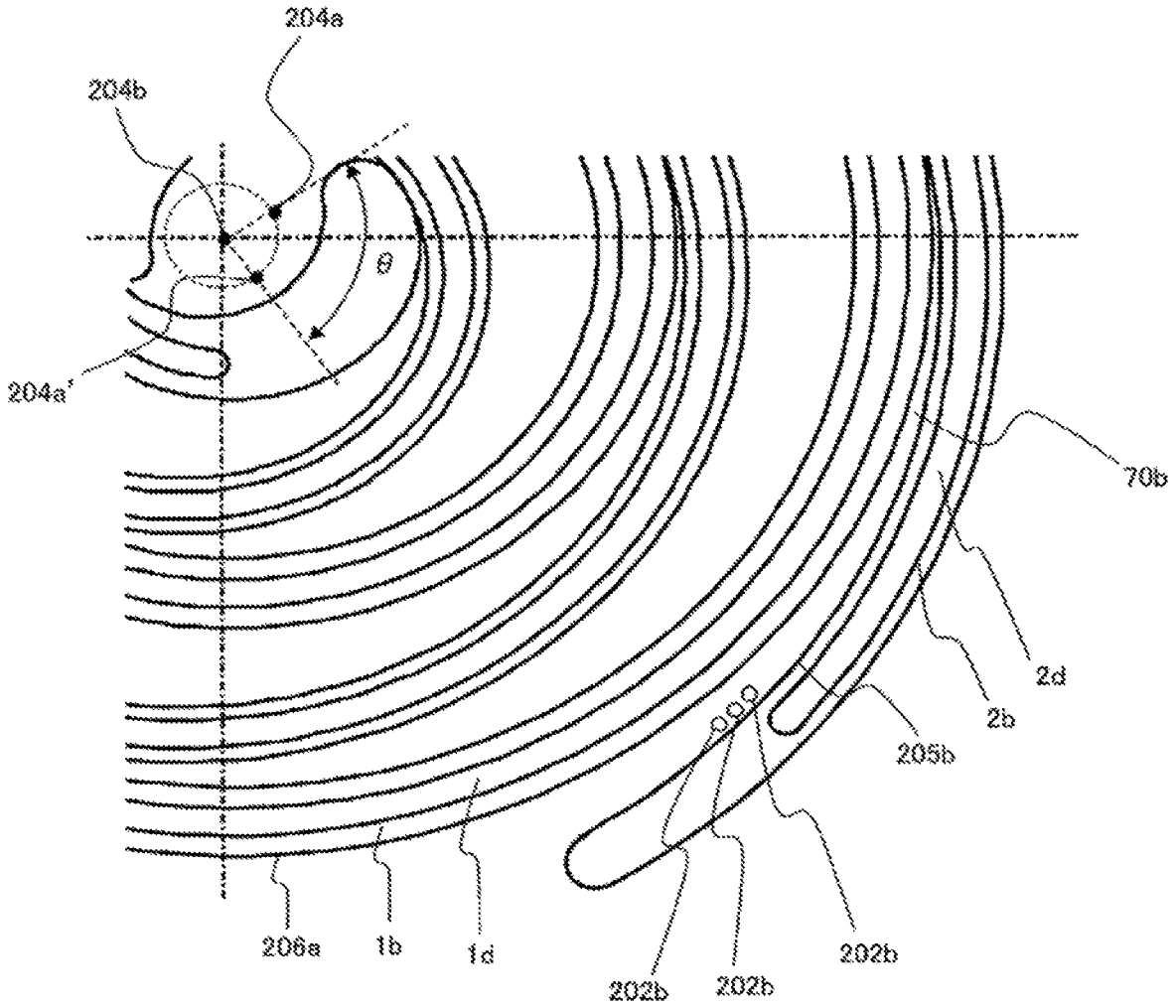
FIG. 15B is a compression process diagram illustrating an operation at θ=90 degrees in one rotation of the orbiting spiral body in the vicinity of the injection ports in the cross-section of the scroll compressor according to Embodiment 6 of the present invention, taken along line A-A in FIG. 1.
Figure 15C:
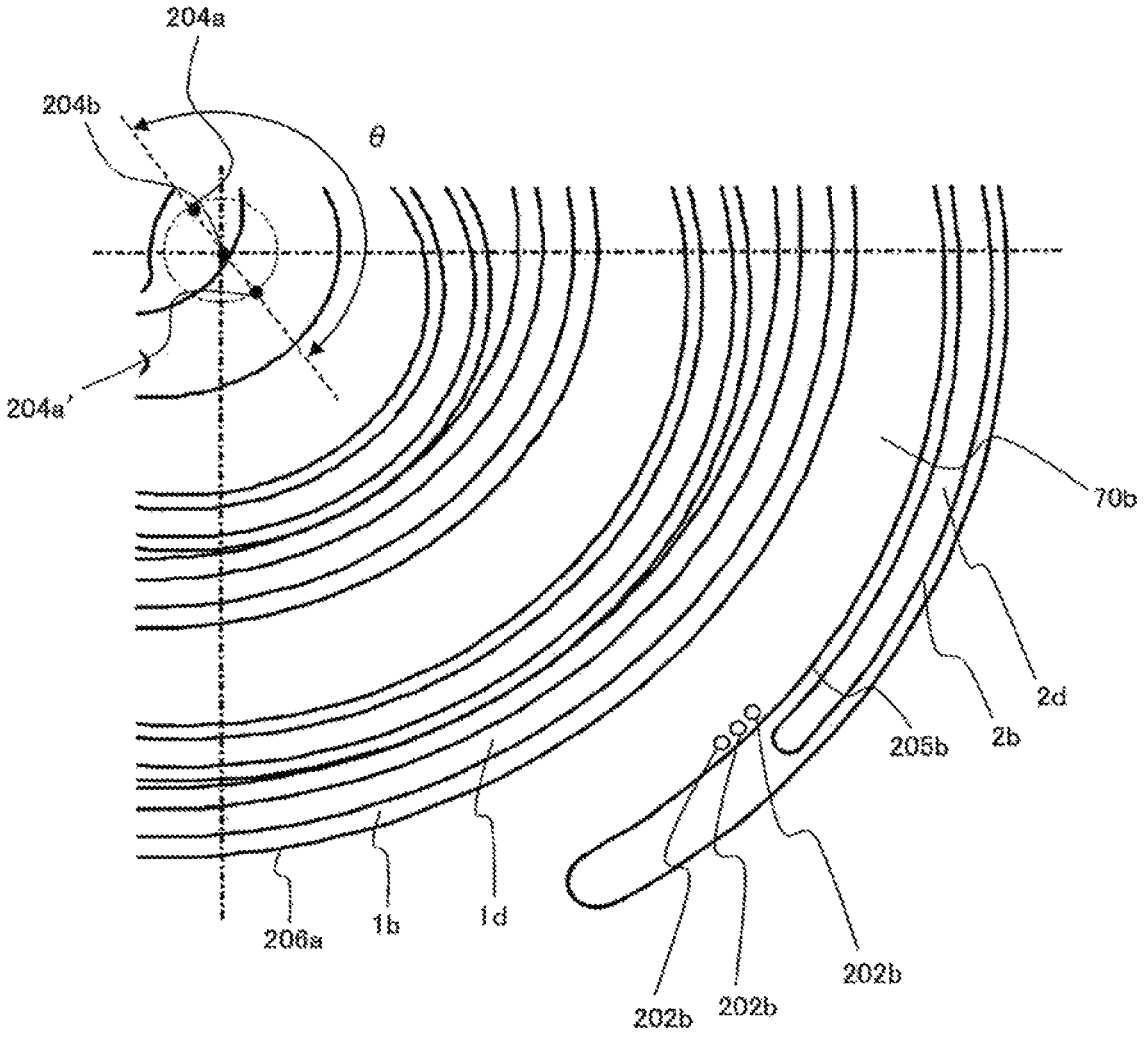
FIG. 15C is a compression process diagram illustrating an operation at θ=180 degrees in one rotation of the orbiting spiral body in the vicinity of the injection ports in the cross-section of the scroll compressor according to Embodiment 6 of the present invention, taken along line A-A in FIG. 1.
Figure 15D:
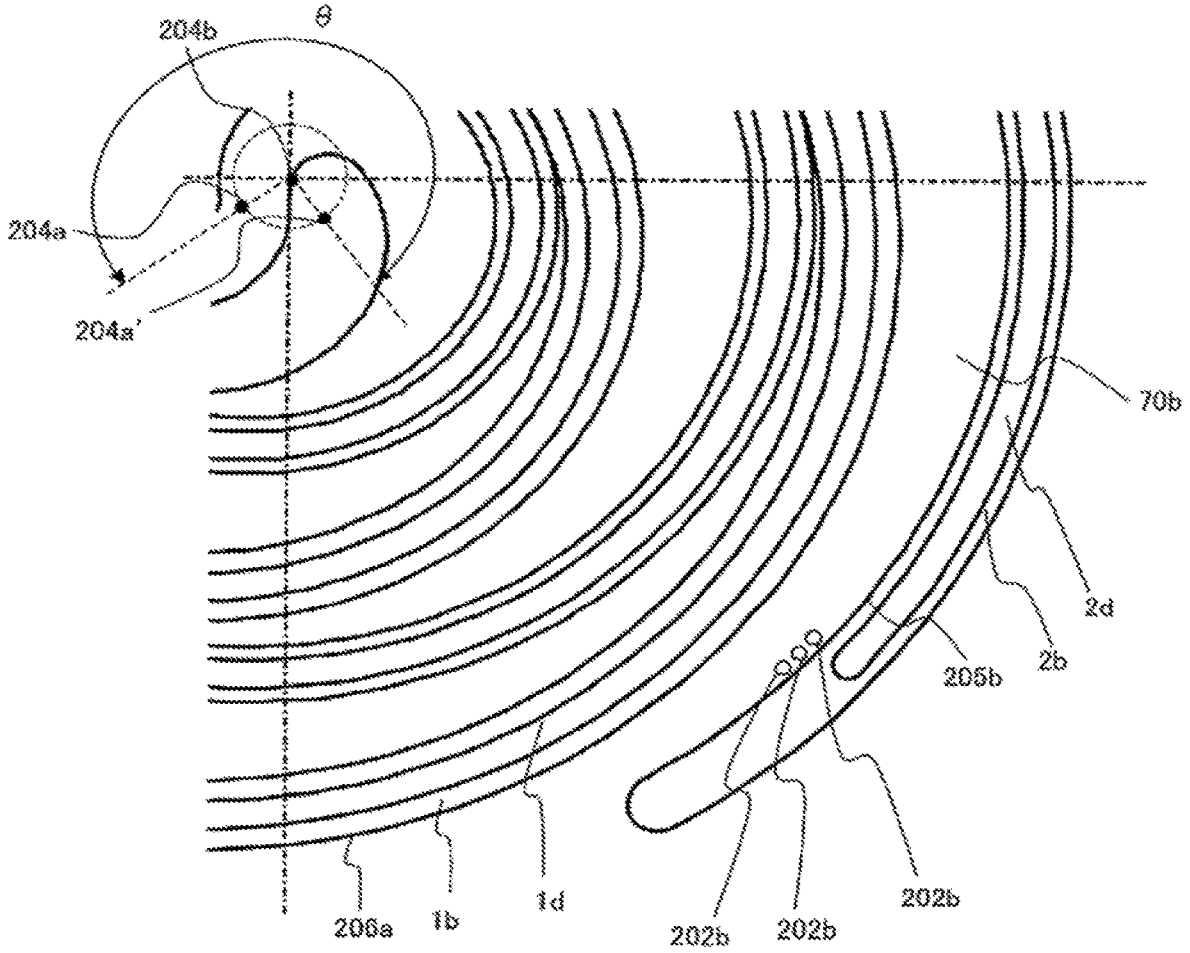
FIG. 15D is a compression process diagram illustrating an operation at θ=270 degrees in one rotation of the orbiting spiral body in the vicinity of the injection ports in the cross-section of the scroll compressor according to Embodiment 6 of the present invention, taken along line A-A in FIG. 1.

FIG. 15A is a compression process diagram illustrating an operation at θ=0 degrees in one rotation of the orbiting spiral body 1*b* in the vicinity of the injection port 202*b* in a cross-section of the scroll compressor 30 according to Embodiment 6 of the present invention, taken along line A-A in FIG. 1. FIG. 15B is a compression process diagram illustrating an operation at θ=90 degrees in one rotation of the orbiting spiral body 1*b* in the vicinity of the injection port 202*b* in the cross-section of the scroll compressor 30 according to Embodiment 6 of the present invention, taken along line A-A in FIG. 1. FIG. 15C is a compression process diagram illustrating an operation at θ=180 degrees in one rotation of the orbiting spiral body 1*b* in the vicinity of the injection port 202*b* in the cross-section of the scroll compressor 30 according to Embodiment 6 of the present invention, taken along line A-A in FIG. 1. FIG. 15D is a compression process diagram illustrating an operation at θ=270 degrees in one rotation of the orbiting spiral body 1*b* in the vicinity of the injection port 202*b* in the cross-section of the scroll compressor 30 according to Embodiment 6 of the present invention, taken along line A-A in FIG. 1. FIGS. 15A to 15D illustrate how the orbiting spiral body 1*b* orbits as the rotation phase θ changes in the following order: 0 degrees→90 degrees→180 degrees→270 degrees.

In Embodiment 6, a plurality of openings of injection ports 202*b* are arranged side by side adjacent to the inward surface 205*b* of the fixed spiral body 2*b* of the fixed scroll 2.

With this configuration, the following effects are achieved in addition to those achieved in Embodiment 4. That is, the injection ports 202*b* having a large opening area can be provided without causing the injection ports 202*b* to interfere with the tip seal 1*d* during orbiting movement. It is thus possible to secure a flow passage area of injection refrigerant and obtain a necessary and sufficient amount of injection.

In Embodiments 1 to 6, the scroll compressor 30 includes the hermetic container 100. The scroll compressor 30 also includes the compression mechanism 8 disposed in the hermetic container 100 and including the orbiting scroll 1 and the fixed scroll 2. The orbiting scroll 1 and the fixed scroll 2 include the orbiting spiral body 1*b* and the fixed spiral body 2*b*, respectively. The orbiting spiral body 1*b* and the fixed spiral body 2*b* are disposed on the orbiting baseplate 1*a* and the fixed baseplate 2*a*, respectively, and combined together to form a plurality of chambers including the compression chambers 71*a* and 71*b*. The scroll compressor 30 also includes the motor mechanism 110 configured to drive the orbiting scroll 1. The scroll compressor 30 also includes the rotation shaft 6 coupled to the orbiting spiral body 1*b*, with the orbiting spiral body 1*b* being eccentric from the motor mechanism 110, and configured to transmit torque of the motor mechanism 110 to the orbiting scroll 1 in such a manner to cause the orbiting scroll 1 to orbit. The tooth tip of the orbiting spiral body 1*b* of the orbiting scroll 1 has the tip seal 1*d*. The fixed baseplate 2*a* of the fixed scroll 2 has the injection port 202*a* that is intermittently opened and closed by the tooth tip of the orbiting spiral body 1*b* of the orbiting scroll 1 as the orbiting scroll 1 orbits. The injection port 202*a* is open to the suction chamber 70*a* of a plurality of chambers at some rotation phases. The injection port 202*a* is located within the installation angle α, which is an angular range defined by a line connecting the winding-end contact point 207*a* of the orbiting scroll 1 at the compression start phase with the base circle center 204*b* of the fixed scroll 2 and one of two lines tangent to the winding-end point locus 210 of the tip seal 1*d* at the tooth tip of the orbiting spiral body 1*b* of the orbiting scroll 1 and passing through the base circle center 204*b* of the fixed scroll 2, the one being closer to the winding-end contact point 207*a*. The injection port 202*a* does not interfere with the tip seal 1*d* at the tooth tip of the orbiting spiral body 1*b* of the orbiting scroll 1.

With this configuration, the scroll compressor 30 can be obtained, which is capable of preventing the injection port 202*a* from damaging the tip seal 1*d*, is highly reliable, and has high-performance.

The bore diameter D of the injection port 202*a* is within a range defined by $D<2(t_0-L_0)$, where $t_0$ is the spiral thickness of the orbiting spiral body 1*b* of the orbiting scroll 1 and $L_0$ is the distance by which the center of the injection port 202*a* is spaced from the outward surface 206*b* of the fixed spiral body 2*b* of the fixed scroll 2.

With this configuration, the scroll compressor 30 can be obtained, which is capable of preventing the injection port 202*a* from damaging the tip seal 1*d*, is highly reliable, and has high-performance. Additionally, it is possible to reduce leakage of injection refrigerant into any space other than the suction chamber 70*a* and the compression chamber 71*a*.

The bore diameter D of the injection port 202*a* is within a range defined by $(t_0-t_1)/2<D$, where $t_0$ is the spiral thickness of the orbiting spiral body 1*b* of the orbiting scroll 1 and $t_1$ is the tip seal width of the orbiting spiral body 1*b*.

With this configuration, it is possible to ensure a necessary and sufficient amount of injection through the injection port 202*a*.

The winding end of the tip seal 1*d* at the tooth tip of the orbiting spiral body 1*b* of the orbiting scroll 1 is shorter than the winding end of the orbiting spiral body 1*b* of the orbiting scroll 1, and the width of the tip seal 1*d* at the tooth tip of the orbiting spiral body 1*b* of the orbiting scroll 1 is smaller than the spiral thickness of the orbiting spiral body 1*b* of the orbiting scroll 1.

With this configuration, the scroll compressor 30 can be obtained, which is capable of preventing the injection port 202*a* from damaging the tip seal 1*d*, is highly reliable, and has high-performance.

The compression mechanism 8 is formed into an asymmetrical spiral structure where the spiral length of the fixed spiral body 2*b* of the fixed scroll 2 differs from the spiral length of the orbiting spiral body 1*b* of the orbiting scroll 1, and the port diameter of the injection port 202 is smaller than or equal to the tooth thickness of the orbiting spiral body 1*b* of the orbiting scroll 1.

This configuration has only one suction port at the winding end of the orbiting spiral body 1*b* and the fixed spiral body 2*b*, and has only one injection port 202. In the asymmetrical spiral structure, the one injection port 202 allows injection into both the suction chambers 70*a* and 70*b* and the port diameter can be increased up to the tooth thickness. This increases the amount of injection and makes it possible to achieve improved performance.

The fixed baseplate 2*a* of the fixed scroll 2 has the injection port 202*b* that is intermittently opened and closed by the tooth tip of the orbiting spiral body 1*b* of the orbiting scroll 1 as the orbiting scroll 1 orbits. The injection port 202*b* is open to the suction chamber 70*b* of a plurality of chambers at some rotation phases. The injection port 202*b* is disposed adjacent to the inward surface 205*b* of the fixed spiral body 2*b* of the fixed scroll 2. The bore diameter of the injection port 202*b* in the spiral thickness direction of the orbiting spiral body 1*b* of the orbiting scroll 1 is smaller than the width of one side of the tooth tip of the orbiting spiral body 1*b* of the orbiting scroll 1, excluding the tip seal 1*d*, when the tooth tip of the orbiting spiral body 1*b* of the orbiting scroll 1 closes the injection port 202*b*. The injection port 202*b* does not interfere with the tip seal 1*d* at the tooth tip of the orbiting spiral body 1*b* of the orbiting scroll 1.

With this configuration, the second injection port 202*b* that opens to the suction chamber 70*b* can be provided. It is thus possible to increase the amount of injection and more effectively reduce the discharge temperature.

The opening of the injection port 202*b* has a long flat shape along the inward surface 205*b* of the fixed spiral body 2*b* of the fixed scroll 2.

With this configuration, the second injection port 202*b* that opens to the suction chamber 70*b* can be provided. With the injection port 202*b* having a flat opening shape and a larger opening area, it is possible to increase the amount of injection and more effectively reduce the discharge temperature.

A plurality of injection ports 202*b* are arranged side by side adjacent to the inward surface 205*b* of the fixed spiral body 2*b* of the fixed scroll 2.

With this configuration, two or more injection ports 202*b* that open to the suction chamber 70*b* can be provided. By providing the plurality of injection ports 202*b* to increase the opening area, it is possible to increase the amount of injection and more effectively reduce the discharge temperature.

The refrigeration cycle apparatus 300 includes the main circuit including the scroll compressor 30, the condenser 31, the expansion valve 32, and the evaporator 33 and configured in such a manner that these components are sequentially connected by pipes to allow refrigerant to circulate therethrough. The refrigeration cycle apparatus 300 also includes the injection circuit 34 branching off a line between the condenser 31 and the expansion valve 32 and connected to the scroll compressor 30.

With this configuration, the refrigeration cycle apparatus 300 can be obtained, which includes the scroll compressor 30 that is capable of preventing the injection ports 202*a* and 202*b* from damaging the tip seal 1*d*, highly reliable, and high-performance.

Note that appropriately combining the components of Embodiments 1 to 6 is originally intended. Embodiments 1 to 6 disclosed herein should be considered illustrative, not restrictive, in all respects. The scope of the present invention is defined by the appended claims, rather than by the description preceding them, and all changes that fall within meanings and scopes equivalent to the claims are therefore intended to be embraced by those claims.

REFERENCE SIGNS LIST

1: orbiting scroll, 1*a*: orbiting baseplate, 1*b*: orbiting spiral body, 1*c*: orbiting bearing, 1*d*: tip seal, 1*e*: boss, 2: fixed scroll, 2*a*: fixed baseplate, 2*b*: fixed spiral body, 2*c*: discharge port, 2*d*: tip seal, 4: baffle, 5: slider, 6: rotation shaft, 6*a*: eccentric shaft portion, 6*b*: main shaft portion, 6*c*: sub-shaft portion, 7: frame, 7*a*: main bearing, 7*b*: boss, 7*c*: cavity, 7*d*: cavity, 8: compression mechanism, 9: sub-frame, 9*a*: sub-frame holder, 10: sub-bearing, 11: discharge valve, 12: discharge muffler, 13: sleeve, 30: scroll compressor, 31: condenser, 32: expansion valve, 33: evaporator, 34: injection circuit, 34*a*: expansion valve, 60: first balance weight, 61: second balance weight, 70*a*: suction chamber, 70*b*: suction chamber, 71*a*: compression chamber, 71*b*: compression chamber, 72: first space, 73: second space, 74: third space, 100: hermetic container, 100*a*: oil sump, 101: suction pipe, 102: discharge pipe, 110: motor mechanism, 110*a*: motor stator, 110*b*: motor rotor, 111: pump element, 201: injection pipe, 202: injection port, 202*a*: injection port, 202*b*: injection port, 204*a*: base circle center, 204*a*': base circle center, 204*b*: base circle center, 205*a*: inward surface, 205*b*: inward surface, 206*a*: outward surface, 206*b*: outward surface, 207*a*: winding-end contact point, 207*b*: winding-end contact point, 208*a*: suction port, 208*b*: suction port, 209*a*: contact point, 209*b*: contact point, 210: point locus, 300: refrigeration cycle apparatus

The invention claimed is:

1. A scroll compressor comprising:

a hermetic container;

a compression mechanism disposed in the hermetic container and including a fixed scroll and an orbiting scroll each including a spiral body disposed on a baseplate, the spiral body of the fixed scroll and the spiral body of the orbiting scroll being combined together to form a plurality of chambers including a compression chamber;

a motor mechanism configured to drive the orbiting scroll; and a rotation shaft coupled to the orbiting scroll, with the orbiting scroll being eccentric from the motor mechanism, the rotation shaft being configured to transmit torque of the motor mechanism to the orbiting scroll to cause the orbiting scroll to orbit, wherein a tooth tip of the spiral body of the orbiting scroll has a tip seal;

the baseplate of the fixed scroll has a first injection port intermittently opened and closed by the tooth tip of the spiral body of the orbiting scroll as the orbiting scroll orbits; and the first injection port is open to a suction chamber of the plurality of chambers at some rotational angular positions of the rotating shaft, and the first injection port is located between a line connecting a winding-end contact point of the orbiting scroll at a compression start phase with a base circle center of the fixed scroll and one of two lines tangent to a winding-end point locus of the tip seal at the tooth tip of the spiral body of the orbiting scroll and passing through the base circle center of the fixed scroll, the one line of the two tangent lines being closer to the winding-end contact point, and the first injection port does not overlap the tip seal at the tooth tip of the spiral body of the orbiting scroll as viewed from an axial direction of the rotation shaft.

2. The scroll compressor of claim 1, wherein a bore diameter D of the first injection port is within a range defined by $D<2(t_0-L_0)$, where $t_0$ is a spiral thickness of the spiral body of the orbiting scroll and $L_0$ is a distance by which a center of the first injection port is spaced from an outward surface of the spiral body of the fixed scroll.

3. The scroll compressor of claim 1, wherein a bore diameter D of the first injection port is within a range defined by $(t_0-t_1)/2<D$, where to is a spiral thickness of the spiral body of the orbiting scroll and $t_1$ is a tip seal width of the spiral body of the orbiting scroll.

4. The scroll compressor of claim 1, wherein a winding end of the tip seal at the tooth tip of the spiral body of the orbiting scroll is shorter than a winding end of the spiral body of the orbiting scroll; and a width of the tip seal at the tooth tip of the spiral body of the orbiting scroll is smaller than a spiral thickness of the spiral body of the orbiting scroll.

5. The scroll compressor of claim 1, wherein the compression mechanism is formed into an asymmetrical spiral structure where a spiral length of the spiral body of the fixed scroll differs from a spiral length of the spiral body of the orbiting scroll, and a port diameter of the first injection port is smaller than or equal to a tooth thickness of the spiral body of the orbiting scroll.

6. The scroll compressor of claim 1, wherein the baseplate of the fixed scroll has a second injection port intermittently opened and closed by the tooth tip of the spiral body of the orbiting scroll as the orbiting scroll orbits; the second injection port is open to a suction chamber of the plurality of chambers at some rotation phases, and is disposed adjacent to an inward surface of the spiral body of the fixed scroll; a bore diameter of the second injection port in a spiral thickness direction of the spiral body of the orbiting scroll is smaller than a width of one side of the tooth tip of the spiral body of the orbit scroll, excluding the tip seal, when the tooth tip of the spiral body of the orbiting scroll closes the second injection port; and the second injection port does not interfere with the tip seal at the tooth tip of the spiral body of the orbiting scroll.

7. The scroll compressor of claim 6, wherein an opening of the second injection port is elongated along the inward surface of the spiral body of the fixed scroll.

8. The scroll compressor of claim 6, wherein a plurality of second injection ports are arranged side by side adjacent to the inward surface of the spiral body of the fixed scroll.

9. A refrigeration cycle apparatus comprising a main circuit including the scroll compressor of claim 1, a condenser, a pressure reducing device, and an evaporator and configured in such a manner that the scroll compressor, the condenser, the pressure reducing device, and the evaporator are sequentially connected by pipes to allow refrigerant to circulate therethrough; and an injection circuit branching off a line between the condenser and the pressure reducing device and connected to the scroll compressor.

* * * * *